US006264322B1

(12) United States Patent
Axtell et al.

(10) Patent No.: US 6,264,322 B1
(45) Date of Patent: Jul. 24, 2001

(54) MODULAR INK-JET HARD COPY APPARATUS AND METHODOLOGY

(75) Inventors: James P Axtell; Trudy L Benjamin, both of Portland, OR (US); David J Lowe, Vancouver, WA (US); Preston D. Seu, Vancouver, WA (US); Blair M. Kent, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/568,277

(22) Filed: May 10, 2000

Related U.S. Application Data

(62) Division of application No. 09/039,735, filed on Mar. 16, 1998, now Pat. No. 6,082,854.

(51) Int. Cl.[7] ..... B41J 21/175

(52) U.S. Cl. ..... 347/108; 347/85

(58) Field of Search ..... 347/37, 44, 49, 347/50, 85, 86, 87, 108

(56) References Cited

U.S. PATENT DOCUMENTS

| | | | |
|---|---|---|---|
| 4,567,494 | 1/1986 | Taylor | 347/30 |
| 4,789,874 | 12/1988 | Majette et al. | 347/37 |
| 4,809,015 | 2/1989 | Bowling et al. | 346/75 |
| 4,831,389 | 5/1989 | Chan | 347/86 |

(List continued on next page.)

FOREIGN PATENT DOCUMENTS

| | | |
|---|---|---|
| 0401944 | 12/1990 | (EP) . |
| 0664218 | 7/1995 | (EP) . |
| 0724959 | 8/1996 | (EP) . |
| 2221426 | 2/1990 | (GB) . |

OTHER PUBLICATIONS

The Hard Copy Observer, Products, Nov. 1991, pp. 4–5.
The Hard Copy Observer, Products, Apr. 1992, pp. 5.
The Hard Copy Observer, Products, Mar. 1993, pp. 18–20.
The Hard Copy Observer, Products, Oct. 1993, pp. 36–39.
Ross N. Mills, Ink Jet Printing–Past, Present and Future, Oct. 30–Nov. 4, 1994, pp. 12–15.

(List continued on next page.)

*Primary Examiner*—N. Le
*Assistant Examiner*—Anh T. N. Vo

(57) ABSTRACT

The present invention provides ink-jet writing engine modules for use with a compatible hard copy engine module, a hard copy apparatus based thereon, and methods of manufacturing, operation, and use. Fluidic and electronic partitioning for ink-jet hard copy apparatus is redefined. Modular separation of a hard copy engine from a writing engine allows a replaceable writing module containing all of the key elements of the ink-jet writing system based on writing system technology requirements, particularly for those most likely to age or fail as a result of time, frequency of use, or end-user actions. The writing engine subsystem includes: one or more printing modules having print head elements with concomitant ink manifold components and ink flow and pressure regulation mechanisms; one or more ink containers—either permanent, refillable, or replaceable; one or more ink formulations; one or more ink delivery means, such as tubes and valves fluidically coupling the ink containers to the ink manifolds; service station components; and a framework to retain the elements in a unitary module, insertable cassette-like manner. The present invention further provides a hard copy engine compatible with such a writing engine. The hard copy engine does not contain any components requiring direct contact with ink. Ink-wetted components are predisposed to ink-jet technological changes without affecting the electrical interface and the mechanical interface between the writing engine and the hard copy engine.

10 Claims, 19 Drawing Sheets

U.S. PATENT DOCUMENTS

| | | | |
|---|---|---|---|
| 4,853,717 | 8/1989 | Harmon et al. | 347/29 |
| 4,968,998 | 11/1990 | Allen | 347/7 |
| 4,992,802 | 2/1991 | Dion et al. | 347/8.7 |
| 5,027,134 | 6/1991 | Harmon et al. | 347/29 |
| 5,067,832 | 11/1991 | Baur et al. | 400/66 |
| 5,103,244 | 4/1992 | Gast et al. | 347/33 |
| 5,115,250 | 5/1992 | Harmon et al. | 347/33 |
| 5,146,243 | 9/1992 | English et al. | 347/29 |
| 5,151,715 | 9/1992 | Ward et al. | 347/33 |
| 5,325,119 | 6/1994 | Fong | 347/86 |
| 5,359,353 | 10/1994 | Hunt et al. | 347/86 |
| 5,396,277 | 3/1995 | Gast et al. | 347/33 |
| 5,409,062 | 4/1995 | Brown et al. | 166/279 |
| 5,409,134 | 4/1995 | Cowger et al. | 222/1 |
| 5,440,331 | 8/1995 | Grange | 347/32 |
| 5,448,270 | 9/1995 | Osborne | 347/29 |
| 5,448,818 | 9/1995 | Scheffelin et al. | 25/509 |
| 5,455,608 | 10/1995 | Stewart et al. | 347/23 |
| 5,455,609 | 10/1995 | Gast et al. | 347/32 |
| 5,506,611 | 4/1996 | Ujita et al. | 347/86 |
| 5,519,422 * | 5/1996 | Thoman et al. | 347/49 |
| 5,539,436 * | 7/1996 | Wilson et al. | 347/37 |
| 5,576,741 | 11/1996 | Johnson et al. | 346/145 |
| 5,614,930 | 3/1997 | Osborne et al. | 347/33 |
| 5,650,811 | 7/1997 | Seccombe et al. | 347/85 |
| 5,689,291 | 11/1997 | Tence et al. | 347/10 |
| 5,798,777 * | 8/1998 | Yoshimura et al. | 347/44 |
| 5,929,883 | 7/1999 | Gunther et al. | 347/85 |

OTHER PUBLICATIONS

The Hard Copy Observer, Products, Aug. 1995, pp.34–38.

The Hard Copy Observer, Products, Mar. 1997, pp. 48–52.

Patent Cooperation Treaty, International Search Report, Jun. 10, 1999.

* cited by examiner

FLUIDIC BLOCK DIAGRAM

DISPOSABLE PRINT CARTRIDGE
FLUIDIC BLOCK DIAGRAM

ELECTRICAL BLOCK DIAGRAM

DESKJET™ 850C PRINTER ELECTRICAL BLOCK DIAGRAM

ELECTRICAL BLOCK DIAGRAM

MODULAR INK-JET HARD COPY APPARATUS AND METHODOLOGY

This is a divisional of copending application Ser. No. 09/039,735 filed on Mar. 16, 1998, now U.S. Pat. No. 5,082,854.

BACKGROUND OF THE INVENTION

1. Field of the Invention

The present invention relates generally to ink-jet technology and, more particularly, to methods and apparatus for producing hard copy with modular ink-jet hard copy devices and systems.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy* [*sic*] *Devices,* chapter 13 (Ed. R. C. Durbeck and S. Sherr, Academic Press, San Diego, 1988).

Fundamentally, FIG. 1 (PRIOR ART) depicts an ink-jet hard copy apparatus, in this exemplary embodiment a computer peripheral printer, 101. A housing 103 encloses the electrical and mechanical operating mechanisms of the printer 101. Generally, operation is directed by an electronic controller (usually a microprocessor or application specific integrated circuit ("ASIC") controlled printed circuit board, not shown) connected by appropriate cabling to a computer (not shown). It is well known to program and execute imaging, printing, print media handling, control functions and data processing logic with firmware or software instructions. Cut-sheet print media 105, loaded by the enduser onto an input tray 107, is fed by a suitable internal paper-path transport mechanism (not shown) to a printing station where graphical or photographical images and alphanumeric text is created. A carriage 109, mounted on a slider rod 111, scans the print medium. An encoder strip 113 is provided for keeping track of the position of the carriage 109 at any given time. A set 115 of individual ink-jet pens, or print cartridges, 117A–117D is releasably mounted into the carriage 109 for easy access (generally, in a full color system, inks for the subtractive primary colors, cyan, yellow, magenta (CMY) and true black (K) are provided). Once a printed page is completed, the print medium is ejected by the transport mechanism onto an output tray 119.

At the heart of an ink-jet hard copy apparatus is the writing instrument itself, commonly called a "print cartridge" or a "pen." As shown in FIG. 2 (the subject of separate patent applications assigned to the assignee of the present invention), an exemplary ink-jet pen 210 includes a body, or shell, 212 that encases an ink reservoir, or an ink accumulator chamber and related print head pressure regulator mechanisms (not shown), containing either fluid ink or hot melt type printing fluid. A print head 214 includes a nozzle plate 216 having a plurality of small (e.g., diameter approximately twenty $\mu$m) orifices 217 from which tiny droplets of ink (e.g., approximately ten picoliters) are ejected onto adjacent print media as the pen(s) scan across a printing zone at a high speed (approximately 25 inches per second, "ips"), depositing ink droplets in patterns that through dot matrix manipulation form alphanumeric text characters or graphic images. A flex circuit 218 includes electrical contacts 220 for connecting the pen 210 to the electronic controller. The print head elements have a limited life due to electrical, thermodynamic, and fluid dynamic loads imposed during operation. Thus, in the current state of the art, a costly and functionally significant portion of the writing system must be replaced with each print cartridge change.

The apparatus elements directly involved with inking a print media—in other words, all components of the system which come into contact with ink other than the print media itself—are referred to hereinafter as a writing engine; non-writing elements of the hard copy apparatus system are referred to hereinafter as a hard copy engine. Cartridges, pens, ink-reservoirs, and the like are referred to as ink-jet consumables. (Use of these terms is for convenience of description and is not intended as any limitation to the scope of the invention, nor should any such intention or limitation be implied therefrom.)

Having become commercially practicable in the early 1980's, ink-jet technology is a relatively young field of invention. In state-of-the-art thermal ink-jet systems, two complementary writing instruments have become commercially viable. The first is the disposable print cartridge type; the second is the semipermanent print head pen type.

The disposable writing instrument has a self-contained reservoir ("on-axis" or "on-board;" generally meaning on the pen carriage subsystem) for storing ink and providing appropriate amounts of ink to the print head during a printing or servicing cycle throughout the life of the writing instrument. When out of ink, the entire print cartridge is replaced by the end-user.

When ink-jet technology was in its early stages, print head life expectancy was more or less equivalent to the amount of ink that was held in the on-board ink reservoir. More recently, advances in the state-of-the-art for print head design and manufacture has led to a longer operational life expectancy for the print head than can be used with a reasonably-sized, non-replaceable ink reservoir. Thus, the development and commercialization of a second commercial type using a replaceable ink writing subsystem that employs a semi-permanent printing element, where the ink is supplied to the print head mechanism from a replaceable ink reservoir located either on-axis or "off-axis," (with respect to the pen carriage subsystem), such as a biased ink bladder or bag (see e.g., U.S. Pat. No. 5,359,353 (Hunt et al.) assigned to the common assignee of the present invention and incorporated herein by reference). This second type of writing instrument, the semipermanent pen, can also include mechanisms for regulating both requisite print head back pressure (in a free-ink ink-jet writing instrument) and the flow of ink from the off-board ink reservoir to the pen (shown in FIG. 2 as having an ink inlet mechanism 222 that would be coupled 223 to the replaceable or refillable off-axis ink supplies 224). In the off-axis type of hard copy apparatus, separate, replaceable or refillable, ink reservoirs are located within the fixed apparatus housing 103, FIG. 1, and appropriately coupled to the moving pen set 115 via ink conduits, such as tubes that are impervious to the ink chemicals. In the on-axis type of hard copy apparatus., separate, replaceable or refillable, ink reservoirs couple to the print head ink interface directly and are located on the moving pen carriage system.

Each commercial configuration has advantages and disadvantages. The disposable print cartridge type writing instrument is simple and easy to use but costly, as the relatively expensive print head mechanism is discarded along with the on-axis ink chamber once the ink is fully consumed. Moreover, the non-replaceable on-axis ink chamber in and of itself inherently limits the number of pages which can be printed due to its relatively small ink capacity. With the increase in print head longevity, end users have turned to refill kits or lower cost re-manufactured print cartridges that are less expensive than replacement with a new print cartridge. The use of ink refill kits is often a messy task. Still further, the need and desire for even less expensive ink continues to grow. The recent commercialization of near photographic quality ink-jet printing has increased the end user's consumption of ink much faster than in the past when simple text and color graphics imagery was the norm. Even traditional business documents are now including more images and complex graphics, thus consuming more ink. Naturally, end user replacement costs increase.

The semipermanent pen type system is potentially more economical to the end-user. The on-axis, replaceable, ink subsystem offers lower cost per page printing, but the end user is required to replace smaller ink reservoirs more often than with off-axis implementations. This is due to the physical limitation of how much ink can be reasonably carried on the carriage system. Similar to the disposable print cartridge system, there are also throughput and size penalties due to the mass and volume of the on-axis ink reservoirs. The off-axis ink reservoir type hard copy apparatus potentially can have a smaller carriage and offer larger ink reservoir; the penalty is a more complex design, including additional intra-apparatus ink delivery mechanisms which add cost. The benefits of the larger ink reservoir are in potentially higher throughput due to a lower mass carriage, lower user intervention rates, and even lower cost per page. In a full color hard copy system using a plurality of semipermanent pens, a plurality of off-axis ink reservoirs, and a concomitant set of interconnects, if a printing error occurs, the source of the problem can be difficult to locate. End-user diagnosis may be impossible unless the manufacturer provides expensive troubleshooting technology. Changes in ink formulation—either by the original equipment manufacturer or by a second source using cheaper materials and chemicals—can result in an end-user inadvertently replacing a reservoir with an incompatible model, again resulting in printing errors or even catastrophic equipment failures. Still further, in some implementations certain elements of the writing subsystem are not replaced with the ink supply, such as reservoir-to-pen tubing, valves, and the like; thus, design criteria—including ink chemical formulations—must be employed so that these elements have a life expectancy as great as that of the hard copy engine components.

Moreover, all of the above configurations require a costly, permanent (i.e., matching the hard copy system life expectancy), service station which includes the primary functions of wiping print head nozzle orifices of pooled ink (wiper(s)), collecting waste ink (spittoon(s)), and providing print head protection by capping during non-use (caps or capping devices). While seemingly a simple device, ink-jet service station technology presents many design challenges. Non-replaceable servicing elements must be designed to last the lifetime of the hard copy engine. For example, design constraints are placed on both product size and printing element servicing algorithms due to the limited capacity of a permanent spittoon. The spittoon must be large enough to hold ink residue from all of the servicing operations over the lifetime of the hard copy engine, not just the writing engine. This limits the volume of ink which can be spit during each service interval. Limiting the amount of ink for print head servicing limits the design flexibility for writing instruments. Furthermore, extended usage can cause some of the servicing elements, namely the cap and wiper to fatigue and wear out, or the spittoon to cake and become a problem. Note also, that print head failures, such as leaking ink, can make the servicing elements inoperable; failed servicing components can cause failures in any new writing instrument subsequently installed. Moreover, if a new print cartridge contains an ink that is incompatible with ink which has been left on the servicing elements from a previous print cartridge, the new print cartridge may fail due to ink contamination from the service station. By not replacing the servicing elements with each new print cartridge, the choice of future inks is limited by the composition of past ink usage. Thus, permanent service stations raise manufacturing and support costs.

One key to the commercial success of both disposable print cartridge and semipermanent pen ink-jet printing systems is the high print quality—approaching photographic, electrophotographic, and laser printing quality—at a relatively low cost achieved through the use of replaceable printing elements. While it is commercially known to package and sell ink-jet components together, the present invention provides a concept using a new approach to both the ink-jet consumables and the hard copy apparatus. The goal is to obtain the benefits of both disposable and off-axis ink-jet technologies without the associated disadvantages of each. As such, re-partitioning of state-of-the-art ink-jet printing components and functions within an ink-jet hard copy apparatus is undertaken.

SUMMARY OF THE INVENTION

In its basic aspects, the present invention provides a modular ink-jet apparatus having a writing engine in which all of the individual elements involved directly with the inking process are combined into one easily storable, disposable, or refurbishable, and swappable module. A compatible hard copy engine is also provided.

In a basic aspect, the present invention provides a hard copy apparatus, having writing engine modules for inking print media, each module including ink-jet printing mechanisms for transferring ink from the writing engine modules to print media, servicing mechanisms for maintaining ink-jet functional integrity of the writing engine module, at least one predetermined ink, at least one ink containing mechanisms for containing a predetermined quantity of the at least one predetermined ink, delivering mechanisms for delivering the ink from the containing mechanisms to the ink-jet printing mechanisms, electrical mechanisms for connecting power and control to the writing engine mechanisms, and housing mechanisms for housing the printing mechanisms, servicing mechanisms, ink, ink containing mechanisms, delivering mechanisms, and electrical mechanisms, in a respective operational configuration as a selectively replaceable unit within the hard copy apparatus; and, hard copy engine mechanisms for delivering print media to and from a printing zone location of a hard copy engine printing station and for locating the writing engine relative to the printing zone location.

In another basic aspect, the present invention provides a writing engine for use with a hard copy apparatus adapted for selectively receiving a writing engine therein, including: ink-jet printing mechanisms for transferring ink to print media; at least one predetermined ink; at least one ink containing mechanisms for containing a predetermined quantity of the at least one predetermined ink; delivering mechanisms for delivering the ink from the containing mechanisms to the printing mechanisms; electrical mechanisms for connecting power and logic signals to the writing engine; servicing mechanisms for servicing the ink-jet printing mechanisms; housing mechanisms for housing the printing mechanisms, ink, ink containing mechanisms, delivering mechanisms, electrical mechanisms, and servicing mechanisms in a unified mounting containment providing a replaceable modular unit; and the housing mechanisms and the ink-jet printing mechanisms having mechanisms for selectively interfacing with the hard copy apparatus when received therein such that the ink-jet printing mechanisms is positioned for printing ink onto the print media.

In another basic aspect, the present invention provides writing module subsystems for an ink-jet hard copy apparatus adapted for receiving at least one writing module subsystem in an operational configuration with the ink-jet hard copy apparatus, each of the writing module subsystems including: all components of the ink-jet hard copy apparatus which come into contact with ink, and mechanisms for selectively coupling and decoupling a writing module subsystem as a unit to and from the hard copy apparatus, respectively, such that writing module subsystems are selectively swappable. The components included mechanisms for protecting fluidic integrity of printhead components when the writing module subsystem is decoupled from the hard copy apparatus.

In another basic aspect, the present invention provides a writing module subsystem for an ink-jet hard copy apparatus adapted for receiving the writing module subsystem in an operational configuration therewith, including: all wet components of the ink-jet hard copy apparatus; mechanisms for electrically connecting the writing module subsystem to the ink-jet hard copy apparatus; mechanisms for mechanically aligning the writing module subsystem to the ink-jet hard copy apparatus; and mechanisms for selectively off-loading the writing module subsystem as a unit from the hard copy apparatus and maintaining functional integrity of the wet components while the writing module subsystem is off-loaded such that a writing module subsystem is reusable by reinserting the writing module subsystem into the ink-jet hard copy apparatus.

In yet another basic aspect, the present invention provides an ink-jet writing engine including a unitary module containing all wet components for an ink-jet hard copy apparatus mounted respectively in an operational construct, having an electrical interface and a mechanical interface for integrating the module into a hard copy apparatus such that there is no fluidic interface between the module and the hard copy apparatus other than the transfer of printing fluid from the module onto print media within the hard copy apparatus.

In yet another basic aspect, the present invention provides an ink-jet writing engine including: a housing; an ink reservoir within the housing; ink contained within the reservoir; a writing instrument within the housing; fluidic coupling between the ink reservoir and the writing instrument; a service station within the housing mounted in operational relationship for servicing the writing instrument; and electronic controls mounted within the housing connected to at least the writing instrument and containing control information specific to the writing engine printing and servicing functionality.

In still another basic aspect, the present invention provides a hard copy engine for a hard copy apparatus adapted for using a cassette-type writing engine containing all wet components of an ink-jet system, including at least one ink reservoir having ink therein fluidically coupled to an inking mechanisms within the writing engine for transferring ink from the writing engine to print media within the hard copy apparatus using ink-jetting processes. The hard copy engine includes: a printing station; mechanisms for transporting print media to and from the printing station; and mechanisms for interfacing the hard copy engine mechanically and electrically with the writing engine, the mechanisms for interfacing including a cassette bay for receiving the writing engine therein for positioning the writing engine relative to the hard copy apparatus, mechanisms for mechanically and electrically engaging and activating the writing engine wet components, and mechanisms for aligning the inking mechanisms of the writing engine to the printing station.

In another basic aspect, the present invention provides a hard copy engine including: an ink-jet printing station; a print media transport mounted relative to the printing station to move print media to and from the printing station; a writing engine mount having a writing instrument interface for aligning writing engine ink-jet writing instruments to the printing station such that writing engines are interchangeable, and an ink-jet service station activator mounted relative to the writing engine mount such that the activator interfaces with a writing engine service station, wherein the hard copy engine has no components that contact ink.

In another basic aspect, the present invention provides a modular hard copy apparatus including: a first unitary module including all hard copy engine components, the first unitary module having a first equipment life expectancy; a second unitary module including all ink-jet writing engine components, the second unitary module having a second equipment life expectancy substantially shorter than the first equipment life expectancy; and located on the first unitary module and the second unitary module, complementary mechanisms for selectively interfacing the second unitary module into the first unitary module such that inserting the second unitary module into the first unitary module automatically forms an operationally ready ink-jet hard copy apparatus wherein the second unitary module is replaceable. Furthermore, the second unitary module is replaceable a plurality of times wherein the number of replacement times is approximately equal to the ratio of the first equipment life expectancy to the second equipment life expectancy.

In another basic aspect, the present invention provides an ink-jet hard copy apparatus including: an integrated first module including all hard copy engine dry components, the integrated first module having a first equipment life expectancy; an integrated second module including all ink-jet writing engine wet components, the integrated second module having a second equipment life expectancy substantially shorter than the first equipment life expectancy; and located on the integrated first module and the integrated second module, complementary mechanical and electromechanical mechanisms for selectively interfacing the integrated second module into the integrated first module such that inserting the integrated second module into the integrated first module automatically forms an operationally ready ink-jet hard copy apparatus wherein the integrated second module is replaceable throughout the first equipment life expectancy.

In a further basic aspect, the present invention provides a method for operating a hard copy apparatus, including capturing an insertable writing engine containing all ink-jet wet components into a compatible hard copy engine such that ink-jet printing functions and ink-jet component servicing functions are automatically integrated into the hard copy apparatus by inserting the writing engine therein.

In another basic aspect, the present invention provides an apparatus for producing hard copy including: an ink-jet writing engine, having a printing element; and an ink-jet hard copy engine, having a receiving station wherein the writing engine and the hard copy engine are selectively interlocked such that the hard copy engine seizes the printing element and further such that the hard copy engine can selectively remove the printing element from the writing engine and transport the printing element to a position for ink-jet printing and selectively return the printing element to the writing engine when not ink-jet printing.

In another basic aspect, the present invention provides an improved ink-jet hard copy system including the combination of a plurality of interchangeable writing engines in the form of cassette modules, each cassette module containing all wet components of an ink-jet hard copy system, the plurality providing differing ink-jet printing capabilities; and at least one hard copy engine, containing no wet components of an ink-jet hard copy system, for selectively receiving at least one cassette module therein for forming an operational ink-jet hard copy system together therewith.

In another basic aspect, the present invention provides an ink-jet system, the system including (1) a writing engine cassette, including: a printing component having an inlet for receiving at least one ink therethrough, a print head, and a manifold component for transferring ink from the inlet to the print head, at least one ink reservoir component fluidically coupled to the printing element; at least one formulation of ink contained within the reservoir; a servicing component for capping and wiping the print head and for receiving waste ink spit by the print head during servicing thereof; a first electronic controller component connected to the print head; a first electrical connector component for connecting power and control signals to the cassette; electrical wiring connecting the first electronic controller to the first electrical connector; a housing containing all components of the cassette; and (2) a hard copy engine, including: a cassette bay for receiving the writing engine cassette therein; a carriage for receiving the printing component when the cassette is received in the cassette bay and for translationally moving the printing component out of and back into the writing engine cassette; a reversing motor coupled to the carriage for providing translational motion thereto; a mechanism for feeding print media to a position proximate to the printing component when the carriage is translationally moving the print component; a second electrical connector component for connecting to the first electrical connector component when the cassette is received into the cassette bay; a second electronic controller for providing power and control signals; electrical wiring connecting the second electrical connector to the second electronic controller; a mechanism for coupling to and activating functions of the servicing component when the cassette is received in the cassette bay; and a housing encompassing the hard copy engine.

In another basic aspect, the present invention provides a hard copy apparatus including: a hard copy engine, having a print media transport subsystem for moving print media through a print zone region of the hard copy engine and a cassette bay for receiving writing engines therein; and a plurality of writing engines for being selectively inserted into the cassette bay and removed from the cassette bay such that insertion into the cassette bay aligns the writing engine to the print zone region, each of the writing engines containing essentially all wet components of an ink-jet hard copy apparatus and wherein each of the writing engines has differing printing characteristics.

In another basic aspect, the present invention provides an ink-jet printing system including: a hard copy engine having a cassette bay; a first writing engine cassette including ink having a first composition; and a second writing engine cassette including ink having a second composition, wherein the first composition and the second composition have mutually incompatibilities for ink-jet printing, the cassette bay selectively receiving either the first writing engine cassette or the second writing engine cassette for printing such that no contamination of the hard copy engine is incurred due to the mutual incompatibilities during serial selection of the first writing engine and the second writing engine.

It is an advantage of the present invention that modular writing subsystems and modular hard copy engine subsystems can be independently developed as improvements to the state of the art progress.

It is an advantage of the present invention that it provides an OEM with the capability of repeatedly converting an installed base of hard copy engines to improved writing engine technologies.

It is an advantage of the present invention that it permits designs which match ink reservoir volumes to print head life expectancy, optimizing component matching for both performance and cost.

It is an advantage of the present invention that it provides a modular approach to ink-jet writing systems that is convenient and economical for end-users and original equipment manufacturers ("OEM") alike.

It is an advantage of the present invention that its modular replacement features virtually eliminate the need for ink-jet writing system troubleshooting procedures.

It is an advantage of the present invention that it improves the manufacturability of ink-jet hard copy engine apparatus by eliminating assembly operation "wet" processes, i.e., those dealing with bulk supplies of ink, tubes filled with ink, and the like.

It is another advantage of the present invention that it uses the fewest number of replaceable individual components, if any, and fewest number of interfaces between the writing engine and the hard copy engine, thereby reducing cost and complexity of operation and use.

It is another advantage of the present invention that full replaceability of the writing engine in a single module provides more degrees of freedom to design modifications in accordance with the advancement of the state of the art and to solve writing engine problems in an installed base.

It is another advantage of the present invention that it permits the OEM to introduce upgrades at very low cost, if any at all, to the end user.

It is another advantage of the present invention that limited-life service station components can be manufactured to specifications for the estimated life of the writing engine module rather than that of the hard copy engine, thereby lowering manufacturing cost.

Because writing system failures can be caused by both too little or too much usage, it is an advantage of the present invention that it provides a writing engine that can have an estimated life expectancy based on either time or usage, e.g., 1-year or a set number of printed pages, whichever occurs first.

It is a further advantage of the present invention that it is adaptable to a variety of repeatedly changing implementations based on type of use: home, office, recreational hobby, child computer use activities, and the like.

It is a further advantage of the present invention that it is adaptable to providing the end user with a variety of selectively swappable modules targeted to producing different hard copy results, e.g., continuous black text, color graphics, grey scale imaging, full color photographic quality printing, and the like, based upon the user's immediate need.

It is a further advantage of the present invention that it is adaptable to providing the end user with a variety of cost options, e.g., slower/lower cost modules versus faster/higher cost modules; low quality/low cost modules versus photographic quality/high cost modules.

It is still a further advantage of the present invention that it provides the OEM with a simpler recycling contingencies.

It is still another advantage of the present invention that it provides the OEM with refurbishing and re-marketing capability.

It is still another advantage of the present invention that it provides a more environmentally conscious product.

It is still another advantage of the present invention chat it provides the OEM and end user with simpler, plug-and-play, product testing procedures.

It is still another advantage of the present invention that a unitary modular writing engine provides the OEM a higher shipped-product reliability factor.

It is yet another advantage of the present invention that it reduces the printing cost per page.

It is yet another advantage of the present invention that it allows an ink-jet hard copy apparatus with a smaller workspace footprint.

It is yet another advantage of the present invention that it allows more variety of writing systems for specialty needs.

It is a further advantage of the present invention that it allows separate hard copy engine and writing engine product development strategies.

It is a further advantage of the present invention that it allows simplified commercial distribution supply chain management.

It is a further advantage of the present invention that it permits separate sourcing of hard copy engines which does not require intimate knowledge of ink-jet technology.

It is yet a further advantage of the present invention that it permits repeated removal and storage of an ink-jet writing subsystem without the need for special mechanisms to prevent degradation prior to reuse.

Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable. While shown as "prior art," it should be recognized that FIG. 1 also represents a generic hard copy apparatus for both the purpose of explanation and the basis for claims to the present invention with respect to components that would be well-know in the art; e.g., housings, paper trays, controls, and the like, for which further detailed explanation is extraneous to an understanding of the present invention. Subtitles are provided herein simply for the convenience of the reader; no limitation on the scope of the invention is intended nor should any be implied therefrom.

Hard Copy Engines

Figure 1:
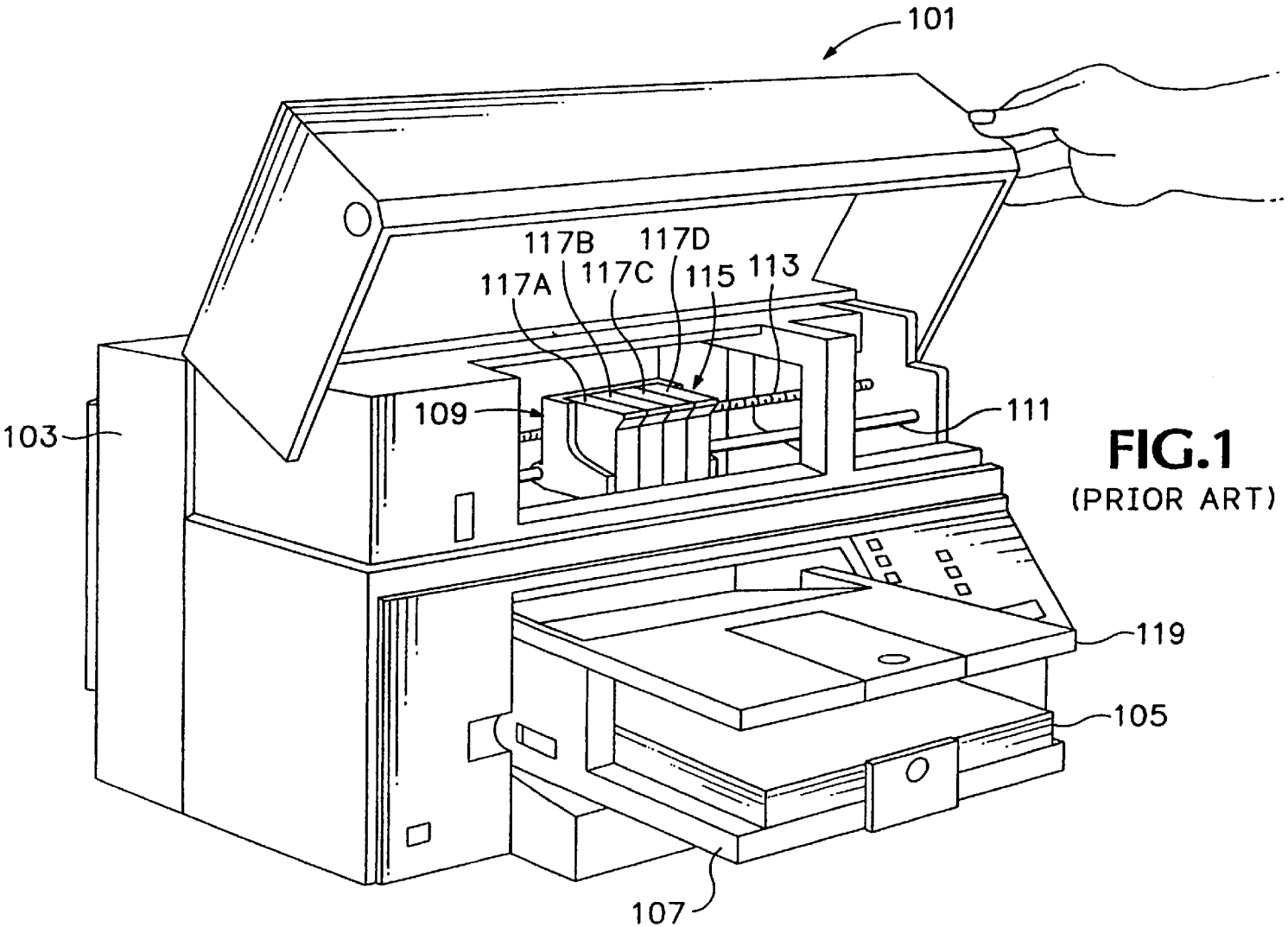
FIG.1 (PRIOR ART)
FIG. 1 (PRIOR ART) is a perspective view, schematic drawing of an exemplary commercial ink-jet hard copy apparatus.

In accordance with the present invention, FIG. 3 demonstrates components of a hard copy engine 301 adapted to interface with a writing engine (as will be described in detail hereinafter with respect to FIG. 4). Outer frameworks, paper trays, electronic controller boards, and other components of a hard copy engine are well-known to persons skilled in the art and inclusion of details is not necessary to an understanding of the present invention. Thus, FIG. 1 depicts those certain hard copy engine features of a complete hard copy apparatus as would be known in the art and used in accordance with the present invention.

A stanchion 303 of frame 337 has a print media stepper motor 305 and print media drive roller transmission 307 suitably mounted thereon. An exemplary print medium, paper sheet 309, is shown, having an swath printing zone 311, as indicated by arrow and phantom lines, which has a swath height approximately the same as a print head orifice height dimension; the swath width is approximately edge-to-edge across the paper sheet. Note however, that as a variety of print head embodiments are known in the art, the printing zone 311 is not limited in practice to merely the swath area indicated; e.g., theoretically, a page length print head could print an entire sheet in one pass. A lower media drive roller 312 moves the media through the printing zone 311 during a printing cycle, usually stepping the media one swath after one or more scans of a printing element. A printing module carriage 313 is adapted for riding on an anti-rotation rod 315 and slider bar 317. A variety of printing module carriage 313 designs can be implemented; in the exemplary implementation shown, the carriage 313 includes a tubular slider 319 encompassing the slider bar 317 and an idler wheel 321 riding atop the anti-rotation rod 315. A reversible drive motor 323 has a drive shaft 325 coupled to a drive belt 327 which in turn is coupled to the carriage 313 such that bidirectional translation motion can be imparted to the carriage 313 to scan a printing module (as will be described in detail hereinafter with respect to FIG. 6) mounted therein across the print medium 309. Other carriage drive mechanisms such as cable-capstan drives, screw drives, and the like as would be known in the art, are compatible with the present invention. Carriage position is tracked through an encoder module 329 mounted on the carriage 313 and an encoder strip 331 mounted on the frame 337; see e.g., U.S. Pat. No. 4,789,874 (Majette, assigned to the common assignee of the present invention and incorporated herein by reference).

While various implementations of the individual hard copy engine elements just described are well-known in the art, the modular adaptation for interface with a unitary writing engine module is unique. In this regard, the printing module carriage 313 includes a bracket 333 having a recess 335 cut therein for releasably receiving a printing module component of a writing engine such that the printing module is captured in a fixed relationship to the carriage 313 by action of installing the entire writing engine module into the hard copy engine 301, or subsequent to insertion of the writing engine by action of moving the carriage to mate with the writing instrument. Thus, the printing module is extractable out of the writing engine to scan across the printing zone 311 and then re-insertable back into the writing engine. The carriage 313 uses its recess 335 and datums 336 as necessary to align the printing module properly with respect to the media printing zone 311.

In other words, along with the development of modular writing engines, the hard copy engine 301 includes specific, compatible writing engine module docking features. The carriage 313 is operationally located to interlock with a writing instrument of a writing engine either as the writing engine is received into the hard copy engine or subsequent to insertion of the writing module by action of moving the carriage to mate with the writing instrument. Note that the hard copy engine 301 is also a modular design specifically adapted for interfacing with a design compatible writing engine module; an ink-jet printing sub-module of the writing engine module is automatically properly engaged and aligned for scanning across a print zone on the print media by the simple act of inserting such a writing engine into the hard copy engine. In the shown embodiment, the hard copy engine 301 has sub-components adapted to take the printing module out of an inserted writing engine to perform printing operations and to put the printing module back into the writing engine when not printing. Clearly, a variety of other commercial implementations are possible. See, e.g., FIGS. 18 and 19 described hereinafter.

Although not illustrated, it is specifically intended by the inventors that a hard copy engine in accordance with the present invention can have more than one writing engine cassette bay for receiving writing engines therein. Moreover, it is recognized that jukebox mechanisms also can be employed to change writing engines in a cassette bay.

Writing Engines

Figure 4:
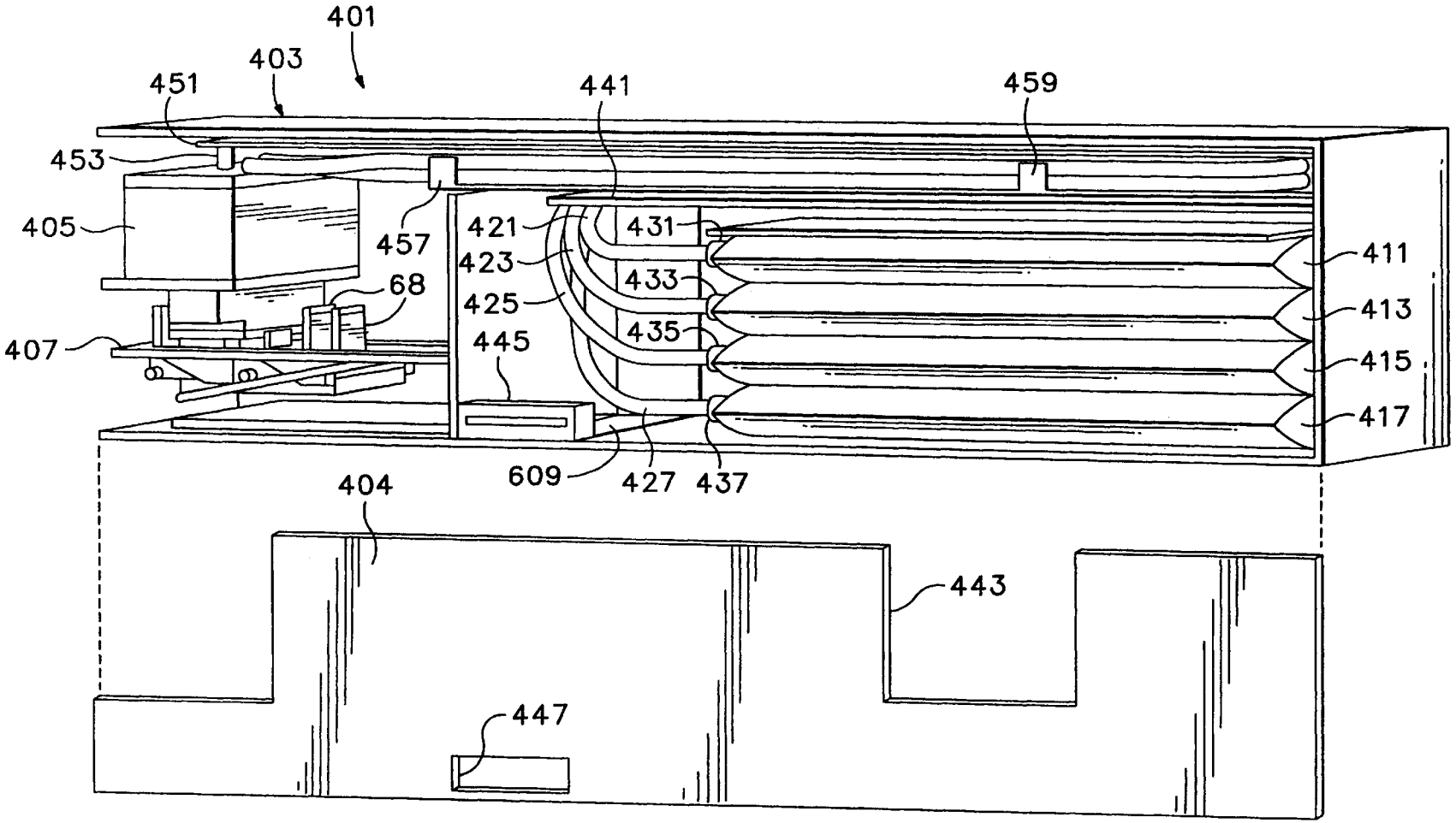
FIG. 4 is a perspective view, partially exploded, schematic drawing of a modular writing engine in accordance with the present invention for use in conjunction with a hard copy engine as shown in FIG. 3.
Figure 4A:
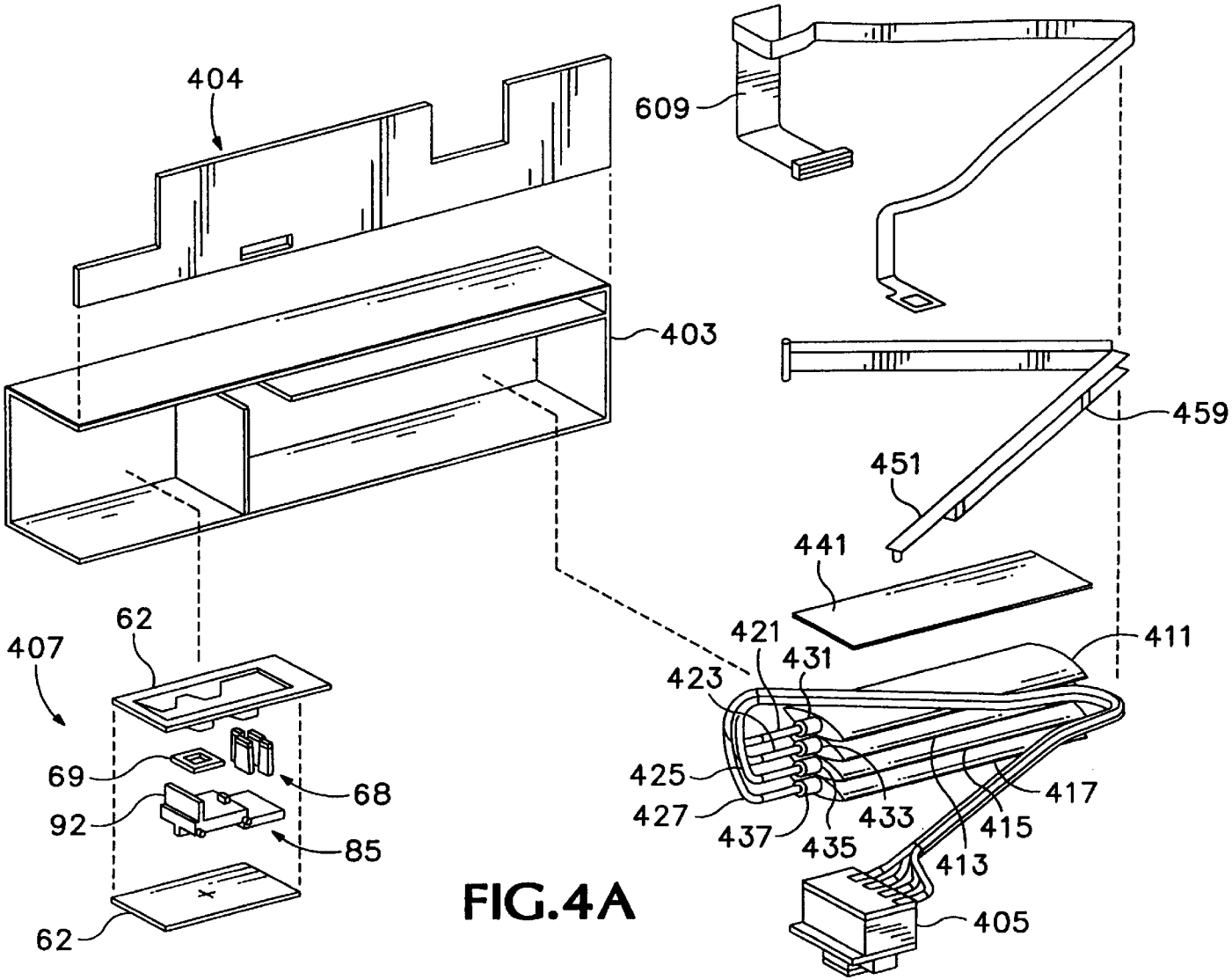
FIG. 4A is an exploded view of the writing engine as shown in FIG. 4.

FIG. 4 depicts an exemplary embodiment of a writing engine 401. As will be obvious to a person skilled in the art, a wide variety of writing engine modules can be designed to fit the needs of a particular commercial implementation. Fundamentally, it is the intent of the inventor's to have a writing engine 401 that separates "wet" ink-jet components, comprising those components which come into contact with ink or directly support components in contact with ink (shells, print head electrical connections, and the like) from the rest of the hard copy apparatus. A housed writing engine unit that is simply inserted by the end-user in the manner of a cassette construct, yet with that simple action achieves full system integration, is a goal in this ink-jet hard copy system re-partitioning. At the end-of-life of the writing engine unit, it is easily removed and disposed of or returned to the OEM for refurbishing or recycling. The hard copy system is rejuvenated by replacing a used, cassette-like, inking system with a new one. The system is altered by swapping a cassette having first printing characteristics with a cassette having different printing characteristics, e.g., a black text printing ink writing engine module for document printing versus a neon ink writing engine module for t-shirt transfer sheet printing.

A writing engine housing 403, forms an encasement for the components of the writing engine 401; the specifications of this housing are subject to the specific design implementation of the hard copy engine to writing engine interface.

The housing 403 encloses a printing submodule 405, a service station module 407, and at least one ink reservoir—four shown for a full color CMYK implementation—411, 413, 415, 417, along with associated ink flow tubes 421, 423, 425, 427, and reservoir-to-tube flow control fluid couplings, such as valves, 431, 433, 435, 437, respectively. The ink flow tubes 421–427 can be appropriately harnessed and guided into and out of the housing 403, where housing facia 404 is provided with an appropriate cut-outs 443, 447 to accommodate the cassette-like insertion of the writing engine 401 into the hard copy engine 301 and subsequent extraction-retraction motion of writing engine components involved in scanning across a sheet of print medium adjacent positioned by the paper transport mechanism. In a simpler construct, rather than a fixed housing facia 404, a simple tear-away covering can be implemented (similar to that commonly used for photocopier toner cartridges) attached so as to be stripped off by the end-user just prior to insertion of the writing engine into the hard copy engine. In order to maximize advantages of the present invention, it is beneficial to simplify the writing engine module 401 such that from the end-user point of view it is both completely integrated for a simple, one-step, cassette-like insertion or removal and completely disposable. For manufacturability, it is beneficial to keep the writing engine's outer shell simple and inexpensive. A simplified plastic, reinforced cardboard, or the like, shell with less molding requirements than a fully molded housing accomplishes this goal.

In the shown exemplary embodiment, the ink reservoirs 411–417 comprise a simple Mylar™ bag, or multiple bag, construct, fixedly located between a housing 403 wall, or bottom, and a pressure plate 441. The ink reservoirs 411–417 may be of any shape, size, construction, and configuration as is suited to a particular writing engine 401 modular implementation.

In the preferred embodiment, the entire writing engine module components comprise a one-time use, disposable, or manufacturer's recyclable or refurbishable, unit—recognizing that "one-time use" also means intermittently swappable with other writing engine modules of different printing characteristics. However, it is also envisioned that writing engine can be designed to provide replaceable or refillable ink reservoirs (as described hereinafter with respect to FIGS. 18 and 19). This, however, would obviate some of the advantages set forth in the Summary of the Invention section above, particularly those related to upgrades that are user transparent, e.g., changes in ink formulations, one-time use life cycle design of service station module components, and the like. Nonetheless, there may be a need for replaceable or refillable ink reservoirs commercially; therefore, replacement reservoirs, multicolor reservoir set, and refill kits (e.g., ink filled syringes as is known in the art) can be manufactured and supplied.

Returning to FIG. 3, the hard copy engine 301 is provided with an ink reservoir pressurization mechanism 339. An L-shaped, pressure applicator 341 has a substantially flat arm 343 adapted for sliding across the top of a pressure plate 441 (FIGS. 4, 14 & 15) movably mounted, such as on a conventional sliding mount (not shown), to the housing adjacent the ink reservoirs 411–417 in the writing engine 401. As the writing engine 401 is inserted into the hard copy engine 301, the arm 343 contacts the plate 441. The arm 343 is mounted on a rod, or other suitable mount, 347 connected to a pressure plate set-and-return lever 349. By spring loading (not shown) the rod 347 or the lever 349, a positive pressure is applied to the ink reservoirs 411–417 by applying a load force to the pressure plate 441 via the arm 343. In other words, by rotation (mechanically or electromechanically, see phantom line 345, FIG. 3) of the pressurization mechanism 339, the pressure plate 441 is forced to exert a pressure on the ink reservoirs 411–417 in order to transfer ink from within the reservoirs to the printing submodule 405 via the valves 431–437 and tubes 421–427. The set-and-return lever 349 is also configured for counter-forcing the bias during installation of a writing engine module 401 into the hard copy engine 301. Returning to FIG. 4, the housing facia 404 is provided with an aperture 443 for receiving the arm 343 therethrough upon inserting the writing engine 401 into the hard copy engine 301 such that the pressure plate 441 is in contact with the arm.

Note that a variety of printing submodule 405 writing instruments can be adapted for use in accordance with the present invention or proprietary printing modules can be newly designed. A specific exemplary embodiment is described hereinafter with respect to FIG. 6. This also means that a variety of refilling techniques and apparatus are also available to the system designer in the state of the art. Ink transfer from an off-axis reservoir need not be limited to the specific exemplary embodiments depicted in the drawings. Any equivalent adapted to a specific implementation may work equally as well. For example, as taught in U.S. Pat. No. 4,968,998 (Allen, assigned to the common assignee of the present invention) for a Refillable Ink Jet Print System, service station ink injection techniques are known in the art.

Similarly, a variety of fluid interconnects and valve mechanisms are available to the system designer. Simple, self-sealing make-or-break types, needle-and-septum types, one-way flow types, and the like, can be employed as would be recognized by a person skilled in the art. Another example in a more sophisticated implementation for an off-axis reservoir with a valved tubing interface between the reservoir and a pen is taught in allowed U.S. patent application Ser. No. 08/523,424 (Johnson et al., assigned to the common assignee of the present invention and incorporated herein by reference) for an Ink-Jet Off Axis Ink Delivery System, in which a controlled, multi-position valve is employed. Other than to recognize that the present invention is not limited to the specific exemplary embodiments depicted in the drawings, further detail for off-axis ink supplies is not essential to an understanding of the present invention. In the preferred embodiment, all fluid connections are non-detachable, improving reliability, reducing cost of manufacture, and reducing size.

Figure 14:
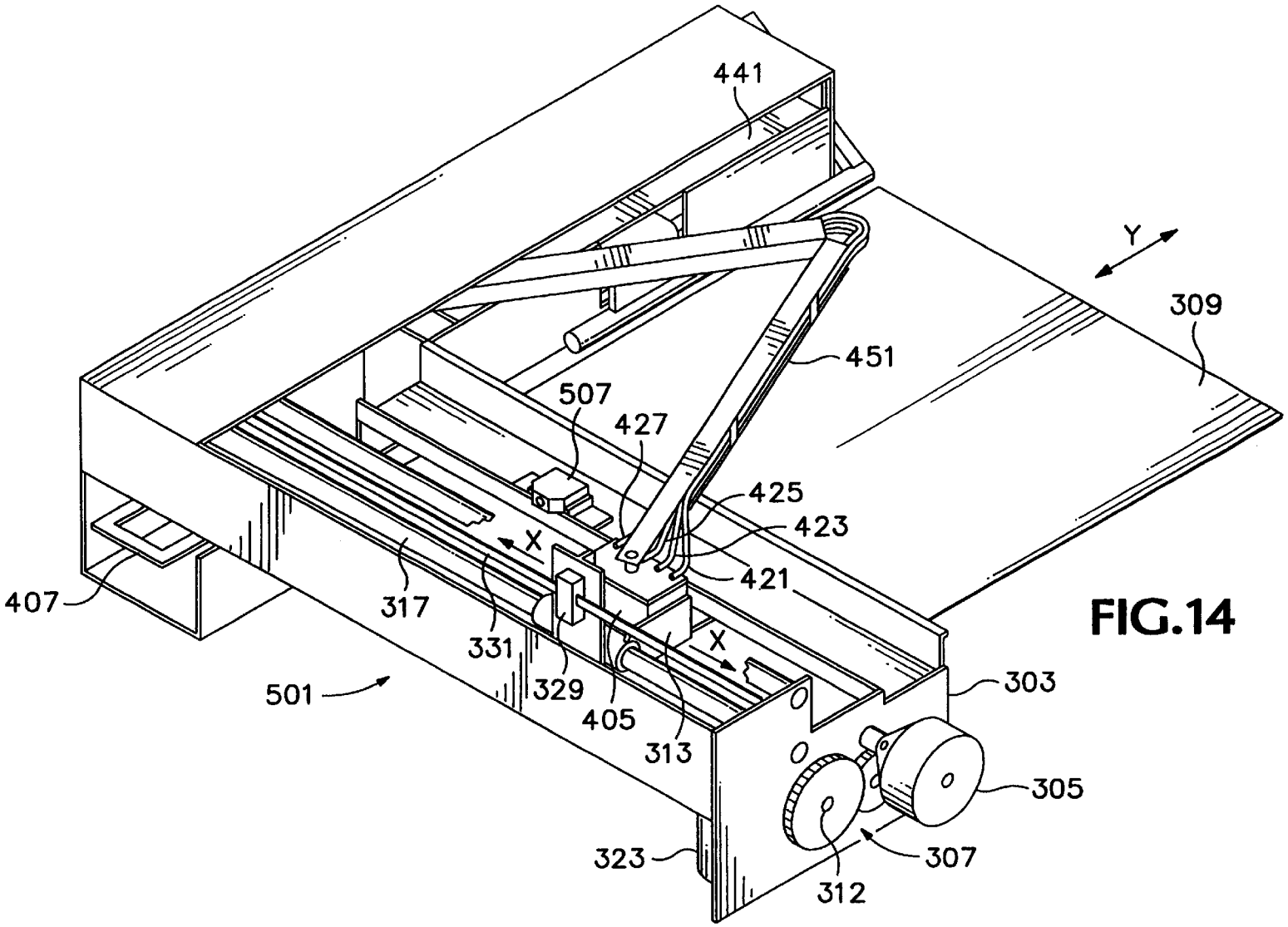
FIG. 14 is a perspective view in accordance with the present invention as shown in FIG. 13 with the writing engine module installed in the hard copy engine in a "printing mode."
Figure 15:
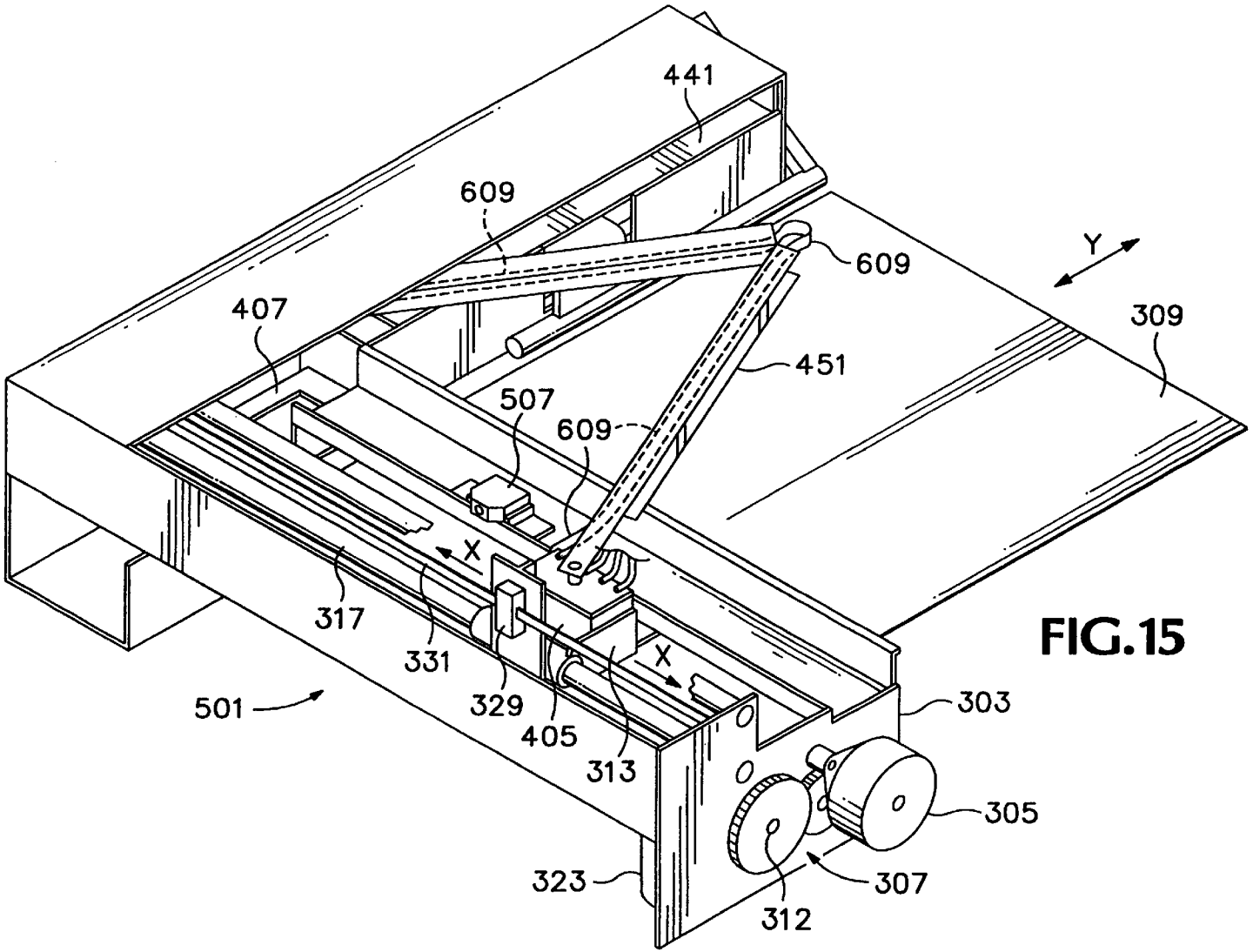
FIG. 15 is a perspective view in accordance with the present invention as shown in FIG. 14 to demonstrate a trailing flex circuit.

As shown in FIGS. 4, 14 and 15, a scissored swing arm 451 has a first end mounted inside the housing via a conventional pivot mount to allow freedom of motion out and back into the writing engine 401. The writing engine housing 403 has an appropriate slot 406 (FIGS. 14 & 15 only) allowing the swing arm 451 to swing in and out of the housing's shell. To carry the ink tubes 421–427 (FIGS. 4 and 14) and electrical wiring, flex circuit 609 (FIG. 15), the swing arm 451 has appropriately sized grooves 455 (best seen in FIG. 15) and clip tabs 457, 459 for securing the tubes and wires in the grooves. The second end of the swing arm 451 is pivotally affixed to the printing submodule 405. When the carriage 313 (FIG. 3) of the hard copy engine 301 extracts the printing submodule 405 from the writing engine 401, the swing arm mounted tubes 421–427 and circuit 609 follow.

System Integration

Figure 5:
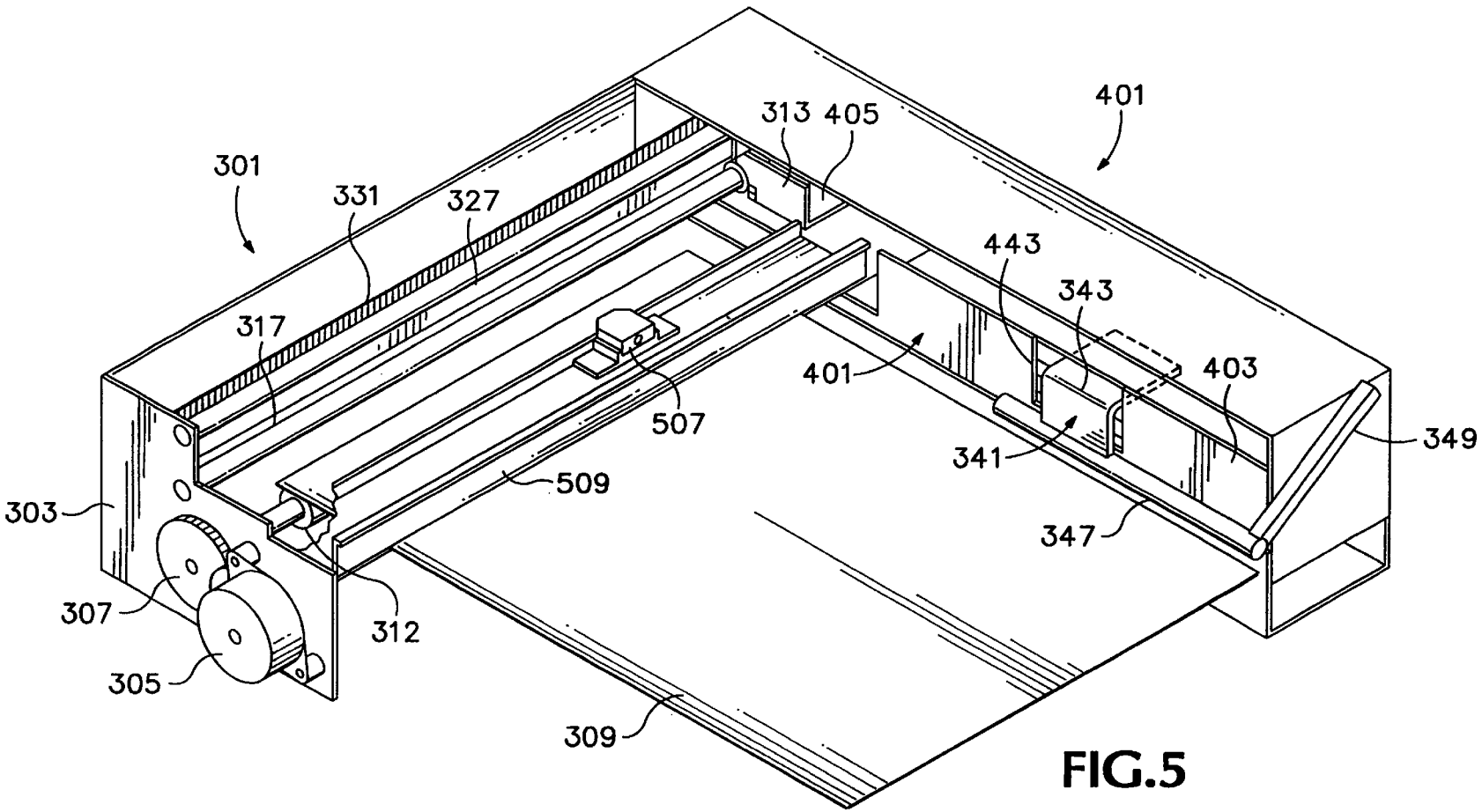
FIG. 5 is a perspective view, schematic drawing of the writing engine as shown in FIG. 4 coupled into the hard copy engine components of FIG. 3.
Figure 5A:
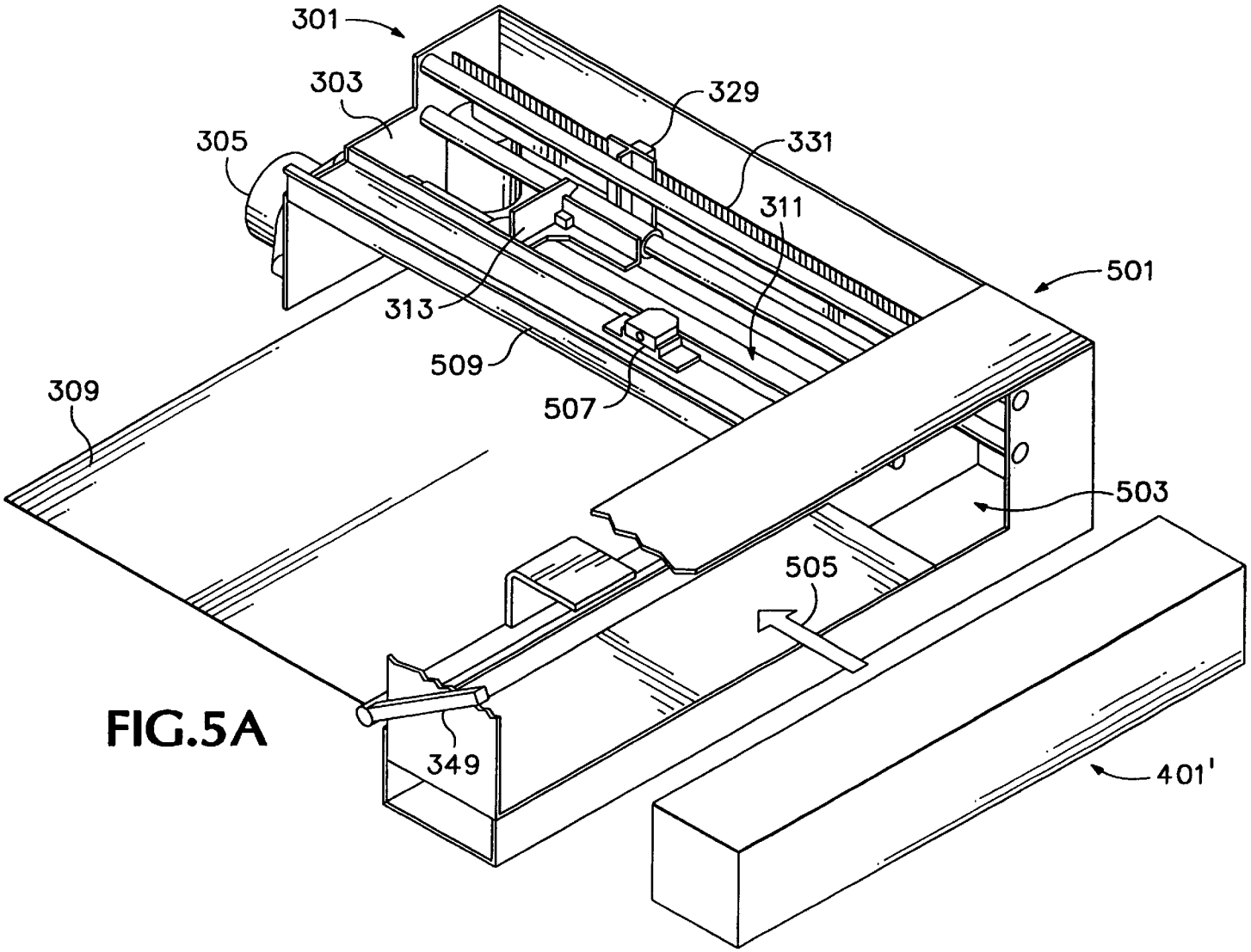
FIG. 5A is a perspective view, schematic drawing of the writing engine as shown in FIG. 4 being inserted into an a hard copy engine as shown in FIG. 3.

As can now be recognized and as shown in FIGS. 5 and 5A, the writing engine 401 and hard copy engine 301 are adapted for mating in a sliding press-fit, or snap-fit, instituted by the end-user's cassette-like insertion of the writing engine into the hard copy engine. Upon or subsequent to insertion, the printing submodule 405 is automatically registered into the recess 335 (FIG. 3) of carriage 313. The printing submodule 405 is mechanically coupled to the carriage 313 in an appropriate orientation for scanning by the simple action of the installation of the modular writing engine 401 into the hard copy engine 301. Again, more complicated, automated, integration systems, like jukebox mechanisms, can be employed for changing writing engine modules.

Returning briefly to FIG. 4, it is further intended that electrical connection between the writing engine 401 and the hard copy engine 301 be affected during the same installation via electrical connector 445 for which an aperture 447 is provided in housing facia 404. A standard electrical connector 445 as known in the art and desired for a specific implementation may be employed. Thus, the number of interface elements between the writing engine 401 and hard copy engine 301 are reduced to a simple electrical interface and a few simple mechanical interfaces. No fluid coupling or interface is required between the writing engine 401 and the hard copy engine 301. This solves many of the prevalent problems of the prior art as listed in the Background of the Invention section above. Inserting a writing engine into a hard copy engine adapted therefor automatically provides the end-user with a fully integrated hard copy apparatus that is ready for use. Use variants or refurbishing are as simple as swapping one writing engine for another.

FIG. 5A depicts further features and design modifications of the modular concept for hard copy engines and writing engines. The hard copy engine 301 is provided with a base frame 501 specifically designed for receiving the writing engine 401 into a framed cavity 503 forming a cassette bay to accommodate a simple, one-step, cassette-like insertion of a writing engine 401 as depicted by the arrow 505. As an important advantage of the present invention, it is intended that the printing submodule 405 (FIGS. 4, 5 & 6) be a low-mass element. Only a limited quantity of ink is on-board during printing. Therefore, monitoring of ink levels in the printing submodule 405 may be required. An ink level detector 507 (FIGS. 5 & 5A) as would be known in the art is mounted on a cross bar 509 of the hard copy engine frame 501 adjacent the scanning carriage 313 sweep zone superposing the print media 309 printing zone 311.

Printing Modules

Figure 6:
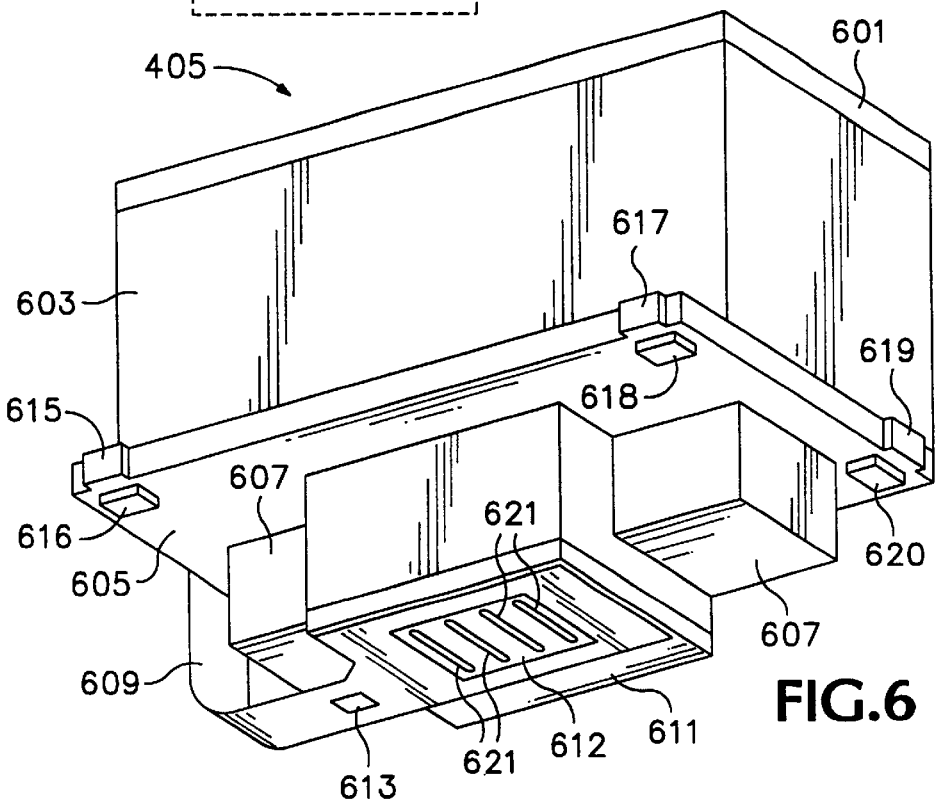
FIG. 6 is a perspective view (bottom angle), schematic drawing of a printing module of the writing engine as shown in FIG. 4.

FIG. 6 demonstrates an exemplary, scanning-type, printing submodule 405 adapted for use in a writing engine 401. An outer shell consists of a pen top 601, an ink container 603, an ink manifold 605, 607, and a print head 611. The print head 611 is connected with one end of a flex circuit 609 which in turn bears a nozzle plate 612 element of the print head in appropriate relationship to the ink manifold 605, 607 and other print head sub-components as would be known in the art (ink drop generator elements and the like; not shown). The preferred embodiment of the present invention is for a thermal ink-jet print head type; however, piezoelectric, wave, and other print heads are also suited for use in accordance with the present invention. The distal end of the flex circuit 609 is adapted for coupling the printing submodule 405 to the electrical connector 445, FIG. 4. The flex circuit 609 can also carry a writing engine controller integrated circuit 613. Datums 615, 616, 617, 618, 619, 620 (and any others incorporated in a specific implementation that might be hidden in a perspective view) are provided as necessary for mating the printing submodule 405 in proper orientation to the carriage 313 as discussed with respect to FIGS. 3 and 5. The embodiment shown is for a full, four color printing module; therefore, four sets of ink-jet orifice arrays 621 are employed. Other arrays may be used in accordance with the intent and purpose of use of any particular writing engine 401. The printing submodule 405 would have inlet mechanisms for receiving each ink from a reservoir coupled thereto (see FIG. 4), depending upon the printing characteristics of the particular writing engine design; e.g., one inlet port for an all-black ink cassette; four inlet ports and a multi-chambered container 603 for a CMYK full-color writing engine cassette, and the like.

The printing submodule 405 in a preferred embodiment is a semipermanent pen type, having mechanisms capable of controlling print head back-pressure and controlling ink flow from the off-axis reservoir(s) into the printing module. Other known manner semipermanent pen mechanisms can also be incorporated into the printing module. Such mechanisms are described in a variety of patents; e.g., U.S. Pat. No. 4,831,389 (Chan), U.S. Pat. No. 4,992,802 (Dion), U.S. Pat. No. 5,409,134 (Cowger), U.S. Pat. No. 5,325,119 (Fong) U.S. Pat. No. 5,448,818 (Scheffelin), and U.S. Pat. No. 5,650,811 (Seccombe), each assigned to the common assignee of the present invention and incorporated herein by reference. A further detailing of these mechanisms is not essential to an understanding of the present invention.

When a writing engine 401 is inserted into a hard copy engine 301 as shown in FIG. 5A, as a fixed element of the printing submodule 405, the print head 611 of the printing module is automatically put in proper alignment for printing operation when the printing module is mated to the carriage 313 (FIG. 3) via the simple mechanical interface 335. In the preferred embodiment, no other electrical or fluid connections need be made between the printing submodule 405 and the carriage 313.

It is intended in a preferred embodiment that the printing submodule 405 be a low mass component having a predetermined supply of ink on-board limited to a volume necessary to ink out a predetermined area of print media, e.g., less than or equal to one page of largest size media compatible with the hard copy apparatus. In other terms, the volume of on-axis ink is substantially less than the volume of ink in a reservoir, e.g. 1/10th the reservoir volume, such that substantially all of the ink is carried off-axis within the writing engine. Small carriage subsystems benefit from two properties, low mass and small volume.

Smaller motors are required to drive the lower mass. Smaller power supplies and drive electronics are required to drive the smaller motors. A smaller mass will allow generally easier noise control. Smaller moving systems usually generate higher frequency noise; the sources of excitation, such as gear train and motor noise, are at higher frequencies. The natural frequencies of the moving systems are higher as the stiffness usually increases faster than the mass. The higher frequencies are easier to control; sound absorption materials are much more effective at higher frequencies. Moving low mass elements are less likely to excite the apparatus enclosure shells or panels, which generate low frequency noise (up to about 3500 Hz). The relatively large panels couple their vibration energy to the air much better than smaller components. Low frequencies are perceived as louder than higher frequencies.

A smaller print mechanism can be implemented without the stiffening required for larger masses. Moving the lower mass subsystem, viz., scanning back-and-forth across the printing zone, causes less printer shaking from reaction to carriage motions. Printer shaking can become substantial as some of the higher mass carriages move back and forth. Less printer shaking allows all the structural support in the printer to be smaller. Moving a smaller mass allows a reduction in the size of carriage supports. Stiffness requirements are reduced in carriage support and drive system components such as carriage drive belts. It is easier to keep resonant frequencies high. Lower resonant frequencies have larger amplitude for a given acceleration level, leading to more velocity ripple. Velocity ripple leads to print defects, especially in color printing when colors no longer align correctly due to slight dot misplacement. Resonant frequencies of motion orthogonal to the carriage scan axis are also easier to keep high. Again the displacements result in print defects usually in the form of periodic color changes. Servo design is easier due to the higher resonant frequencies. A smaller mass allows higher speed. To effectively utilize higher carriage speed requires greater accelerations. The higher acceleration is required to keep the acceleration ramp lengths and times the same. Since in accord with Newton's laws, F=mA, a lower mass requires less force to accelerate. To obtain substantial benefits from 60-inches per second ("ips") carriage speeds in an 8-inch wide printer requires 3-g's acceleration compared to the current 1-g acceleration currently used to reach 20 ips.

Similarly, significant benefits are derived from having a relatively small volume of ink on-axis. Less over-travel is required to enable printing with all dots across the width of the print head. Products are smaller, both in height due to pen height and width due to less over-travel. With desk space tight in many commercial applications, smaller workspace footprint products are desired. Shipping costs are reduced due to more units fitting on a single bulk shipment pallet. Smaller products allow meeting the stiffness and strength requirements with smaller cross section structures. Stiffness is proportional to the inverse of the length cubed. If there is less distance between linear orifice arrays, the displacement from ideal position due to velocity ripple is less. This reduces the color misalignment for a given velocity ripple.

These benefits of a low mass printing module and associated carriage can be used either to reduce cost or increase performance. Smaller size for the same performance will give a lower cost system. Higher accelerations and less over-travel allow higher throughput if everything else in the system remains the same.

Note that an alternative embodiment can be designed in which the printing module is not actually extracted from the writing engine. By orienting the writing engine across the paper transport axis, the y-axis (see FIG. 14), it is simple to envision an arrangement in which a carriage mechanism of the hard copy engine reaches into the writing engine to grasp a writing module mounted within the writing engine to traverse the printing zone without leaving the writing engine. Such an embodiment will be described hereinafter with respect to FIGS. 18 and 19. Similarly, a page wide print head, once aligned to the hard copy engine, can print the entire printing zone without any motion of the writing instrument. In such alternative embodiments, there is still no fluidic interaction between the writing engine module and the hard copy engine except for the transfer of printing fluid from the writing engine directly onto the print medium.

Service Stations

The fundamentals of ink-jet service station technology are known in the art. U.S. Pat. No. 4,567,494 (Taylor), filed Jun. 29, 1984, is an early patent for Nozzle Cleaning, Priming and Capping Apparatus for Thermal Ink Jet Printers, assigned to the common assignee of the present invention and is incorporated herein by reference. Start-up and service procedures are also known in the art.

A service station can provide a number of useful functions, including:

1. clearing clogged nozzles and removing bubbles from a pen;
2. covering nozzles when a print head is not in use to prevent contamination thereof;
3. preventing ink from drying out in the nozzles when a print head is not in use;
4. wiping off nozzle contaminants picked up during printing; and
5. providing a location for firing nozzles into for clearing out deprimed nozzles.

U.S. Pat. No. 5,455,608 (Stewart et al.) for a Pen Start Up Algorithm for Black and Color Thermal Ink-Jet Pens is exemplary of such service station operating procedures (assigned to the common assignee of the present invention and incorporated herein by reference).

A plurality of service station designs and operations are known in the art. More than one, or a combination design is compatible with the present invention.

In a first example, the HP DeskJet 850C printer empioys a rotary type service station which orthogonally wipes the linear orifice arrays of the print head nozzle plates of print cartridges used with this model. Rotary type service stations are shown in U.S. Pat. No. 5,115,250 (Harmon et al., filed Jan. 12, 1990) for a Wiper for Ink-Jet Printhead; U.S. Pat. No. 5,103,244 (Gast et al., filed Jul. 5, 1990) for a Method and Apparatus for Cleaning Ink-Jet Printheads; U.S. Pat. No. 5,146,243 (English et al., filed Jul. 29, 1991) for a Diaphragm Cap System for Ink-Jet Printers; U.S. Pat. No. 5,614,930 (Osborne et al., file Oct. 28, 1994) for a Orthogonal Rotary Wiping System for Inkjet [sic] Printheads (each of which is assigned to the common assignee of the present invention and incorporated herein by reference).

In another example, "elevator" service stations are also known in the art as shown in U.S. Pat. No. 5,396,277 (Gast et al., filed Sep. 25, 1992) for a Synchronized Carriage and Wiper Motion Method and Apparatus for Ink-Jet Printers; U.S. Pat. No. 5,455,609 (Gast et al., filed Sep. 30, 1992) for a Printhead Servicing Station for Printers; U.S. Pat. No. 5,440,331 (Grange, filed Dec. 21, 1992) for a Printhead Servicing Apparatus (each assigned to the common assignee of the present invention and incorporated herein by reference).

A translationally moving sled that also rises into an elevated capping position is shown in U.S. Pat. No. 4,853,717 (Harmon et al., filed Oct. 23, 1987) for a Service Station for Ink-Jet Printer (assigned to the common assignee of the present invention and incorporated herein by reference).

As will be recognized by a person skilled in the art, employing one or more of these service station techniques is applicable to the present invention. The commonality of use is that it is preferable to have the service station within the writing engine, although a service station activator can be part of the hard copy engine.

For example, a main problem with replaceable ink cartridges in the state-of-the-art is that when not in use, an ink-jet print head must be capped to prevent problems such as drooling and crusting of ink that would render the pen inoperative. [Capping also is known in the art; for examples, see U.S. Pat. No. 5,027,134 (Harmon et al., filed Sep. 1, 1989) for a Non-Clogging Cap and Service Station for Ink-Jet Printheads; U.S. Pat. No. 5,448,270 (Osborne, filed Nov. 16, 1994) for an Ink-Jet Printhead Cap Having Suspended Lip (both assigned to the common assignee of the present invention and incorporated herein by reference).] In some low cost home printers, pens are regularly swapped; black for text printing, color for graphics. Separate storage and capping devices must be provided with such pens. Moreover, it has been found that different ink chemical formulations require caps formed of materials that are compatible. The present invention solves these problems because the writing engine includes the servicing elements. The print head is fully capped when not in use whether the writing engine itself is installed or stored outside the printer. This allows an engine to be swapped with one having different printing characteristics. For example, an office may have a "text writing engine" containing only a large volume, black ink reservoir which gets extensive daily use and a "color graphics writing engine" containing cyan, magenta, yellow and black ink reservoirs which only sees occasional use.

Similarly, print head wipers are subject to wear and tear. Exemplary wipers are taught by the assignee of the present invention in U.S. Pat. No. 5,151,715 (Ward et al., filed Jul. 30, 1991) for a Printhead Wiper for Ink-Jet Printers (assigned to the common assignee of the present invention and incorporated herein by reference). Having the wipers replaced whenever a writing engine is replaced substantially eliminates the need for any maintenance.

During operation, partial occlusions or clogs in the print head nozzles and orifices are periodically cleared by firing a number of drops of ink through each of the nozzles in a clearing or purging process known as "spitting." The waste ink is collected at a spitting reservoir portion of the service station, known as a "spittoon." In prior art spittoons, most of the spit ink landed in the bottom of the spittoon. Some of the ink, however, ran down the walls of the spittoon tube or "chimney" under the force of gravity and into a reservoir, where many solvents evaporated. Sometimes the waste ink solidified before reaching the reservoir, forming stalagmites/stalactites from ink deposits along the sides of the chimney. These ink stalagmites/stalactites often grew and clogged the entrance to the spittoon. To avoid this phenomenon, conventional spittoons must be wide, often over 8mm in width, to handle a high solid-content ink. Since the conventional spittoons were located between the print zone and the other servicing components, this extra width increased the overall printer width, resulting in additional cost being added to the printer, in material, and shipping costs. Moreover, this greater printer width increased the overall printer size, yielding a larger footprint, that is, a larger working space required to receive the printer, which was undesirable to many consumers.

As mentioned above, conventional spittoons were located between the print zone and the other servicing components, and to minimize the impact on printer width, the conventional spitoons were only wide enough to receive ink from one print head at a time. Thus, the conventional spitting routine of a multi-pen unit first positioned one print head over the spittoon for spitting, then the pen carriage moved the next pen over the spittoon for spitting. Unfortunately, all this carriage motion not only slows the spitting routine, but it is also noisy.

Besides increasing the solid content, mutually precipitating inks have been developed to enhance color contrasts. For example, one type of color ink causes black ink to precipitate out of solution. This precipitation rapidly fixes the black solids to the page, which prevents bleeding of the black solids into the color regions of the printed image. Unfortunately, if the mutually precipitating color and black inks are mixed together in a conventional spittoon, they do not flow toward a drain or absorbent material. Instead, once mixed, the black and color inks rapidly coagulate into a gel with some residual liquid.

Thus, the mixed black and color inks not only may exhibit a rapid solid build-up, but the liquid fraction may also tend to run and wick (flowing through capillary action) into undesirable locations. To resolve the mixing problem, some printers used two conventional stationary spittoons, one for the black ink and one for the color inks. Unfortunately, each of these dual spittoons must be wide enough to avoid clogging from stalagmites/stalactites growing inwardly from the side walls of the spittoon chimney. Such a dual-spittoon design, with the spittoons located between the printhead and other servicing components, further increased the overall width and footprint of the printer. Furthermore, besides growing from the sides of the spittoon, the ink stalagmites/stalactites sometimes grew upwardly from the bottom of the spittoon. To prevent these stalagmites/stalactites from interfering with the printhead over time, the use of very deep spittoons was typically required, which could also increase the overall printer size.

Again, many of the problems associated with spitting and spittoons are solved by having spittoons that are discarded with the writing engine.

Details of a type of translational motion service station such as shown herein in FIGS. 4, 5, 13 and 14 and that may be employed in accordance with the present invention is described in U.S. patent application Ser. No. 08/862,952, filed May 30, 1997, for a Translational Service Station for Imaging Inkjet Printheads, assigned to the common assignee of the present invention, incorporated herein by reference in its entirety, and repeated herein in pertinent part with a drawing therefrom labeled FIG. 16 herein.

Figure 16:
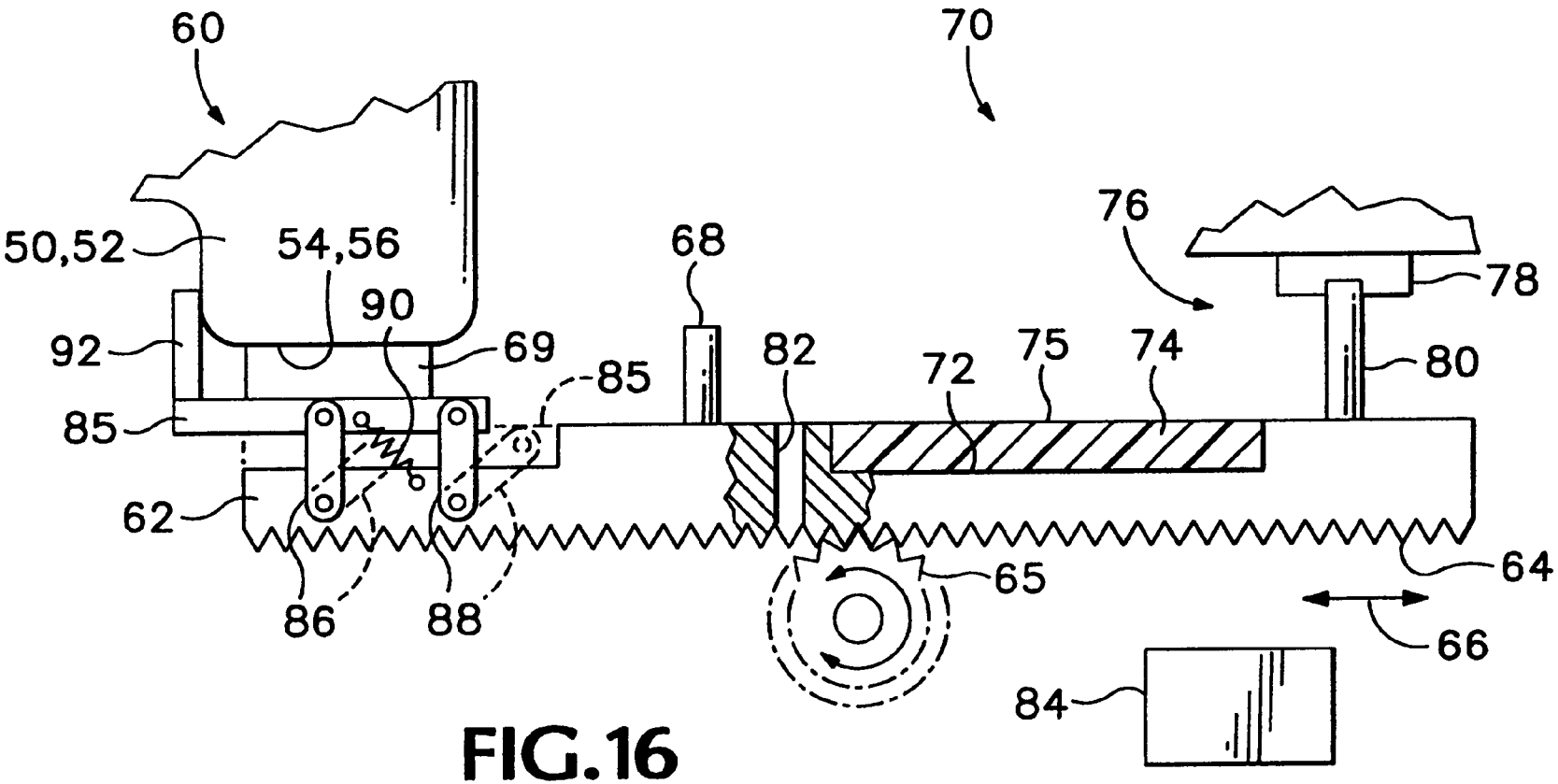
FIG. 16 is an elevation drawing schematically depicting an exemplary embodiment service station, its hard copy engine interface, and its operation as may be employed in the present invention as shown in FIGS. 13 and 14.

FIG. 16 schematically shows the operation of a basic translational service station 60 constructed in accordance with the present invention that may be located as shown in FIGS. 4, 5, 13 and 14 generally designated as service station module 407. The service station 60 has a translating platform or pallet 62, which may be driven linearly using a variety of different propulsion devices, such as a rack gear 64 formed along the underside of the pallet and driven by a pinion gear 65. The pinion gear 65 may be driven by a conventional motor and gear assembly (not shown) for translational motion as indicated by double headed arrow 66. In the current implementation, pinion gear 65 and associated drive motor and gear assembly becomes an element of the hard copy engine 301, FIGS. 3, 5, 5A, 13, 14, and 15. The pallet 62 carries various servicing components, such as a pair of conventional wipers 68 and a pair of caps 69, each of which may be constructed from any conventional material known to those skilled in the art, but preferably, they are of a resilient, non-abrasive, elastomeric material, such as nitrile rubber, or more preferably, ethylene polypropylene diene monomer (EPDM).

The pallet 62 may also carry an absorbent or a non-absorbent purging or spitting station portion 70, which receives ink that is purged or "spit" from the ink-jet print heads 54, 56 attached to writing module's ink manifold and ink drop generator sections 50, 52. Located along a recessed spit platform portion 72 of the pallet 62, the preferred embodiment of spit station 70 includes an absorbent spit target, such as a spit pad 74, which is preferably made of a porous absorbent material. Preferably, the pad 74 is a wettable polyethylene compact material, particularly a porous compact material having surface and chemical treatments of the polymer so that it is wettable by the ink. One suitable pad material is commercially available under the trade name Poron, manufactured by the Porex Company of Atlanta, Ga. Alternatively, the spit pad 74 may be of a polyolefin material, such as a polyurethane or polyethylene sintered plastic, which is a porous material, also manufactured by the Porex company. In a preferred embodiment, the absorption of the pad 74 is enhanced by prewetting the pad to better transport the ink vehicle or solvents through the pad pores. The pad 74 may be prewetted either before, during, or after assembly of pallet 62, using for example, a Polyethylene Glycol ("PEG") compound; however prewetting before assembly is preferred. Another suitable porous pad 74 may be of a sintered nylon material.

The spit pad 74 has an exterior surface serving as a target face 75. Preferably, the pad face 75 is located in close proximity to the print heads 54 and 56 during spitting, for instance on the order of (0.5 to 1.0 millimeters). This close proximity is particularly well-suited for reducing the amount of airborne ink aerosol. The spit platform 72 is substantially flat, although a contour for drainage or for air circulation to assist evaporation may be useful. The illustrated spit pad 74 is of a substantially uniform thickness, so the target face 75 is also substantially flat or planar in contour, although other surface contours may be useful, such as a series of grooves or other patterns to increase the target surface area for absorption.

To remove any surface accumulation of ink residue or other debris from the target face 75, the service station 60 may also include a spit pad scraper device 76. The illustrated scraper 76 has a support device 78 that mounts a blade member 80. To engage the target surface 75 with the scraper blade 80, the pallet 62 moves in the direction of arrow 66 so the scraper can clean target face 75. This spit debris is pushed by the scraper blade 80 into a drain or dump hole 82 formed through the pallet 62, which the debris falls through for collection in a bin 84 or other receptacle. So the target scraper 76 does not interfere with the print head wipers 68, the wipers 68 have been positioned inboard from the spit pad 74.

A preferred material for the scraper blade 80, is a resilient, non-abrasive, elastomeric material, such as nitrile rubber, or more preferably, ethylene polypropylene diene monomer (EPDM), or other comparable materials known in the art. Another preferable elastomeric material for the scraper blade 80 is a polypropylene polyethylene blend (in a ratio of approximately 90:10), such as that sold under the trade name, "Ferro 4," by the Ferro Corporation, Filled and Reinforced Plastics Division, 5001 O'Hara Drive, Evansville, Ind. 47711. This Ferro 4 elastomer is a fairly hard material, that is not as elastic as typical EPDM wiper blades. The Ferro 4 elastomer has very good wear properties, and good chemical compatibility with a variety of different ink compositions. For example, suitable durometers (Shore scale A) for the scraper blade 80 may range from 35 to 100. In some implementations, hard scrapers, such as of a plastic like nylon, for example, may be suitable for cleaning the target pad 75. Indeed, a scraper formed of steel wire is not only inexpensive, but also allows encrusted ink to be easily broken away from the scraper.

To bring the wipers 68 and caps 69 into engagement with the print heads 54 and 56, the pallet 62 is moved in the direction of arrow 66, with the capped position being shown in FIG. 16. The pair of caps 69 are mounted to the pallet 62 using a print head or carriage engaging cap elevation mechanism that includes a spring-biased sled 85. The sled 85 is coupled to pallet 62 by two pair of links 86 and 88, for a total of four links, each to the pallet 62 and the sled 85. Of the four links, only the two are visible in FIG. 16, with the remaining two links being obscured from view by the two links which are shown. The sled 85 may be biased into the lowered position, shown in dashed lines in FIG. 16, by a biasing member, such as a spring element 90.

Figure 3:
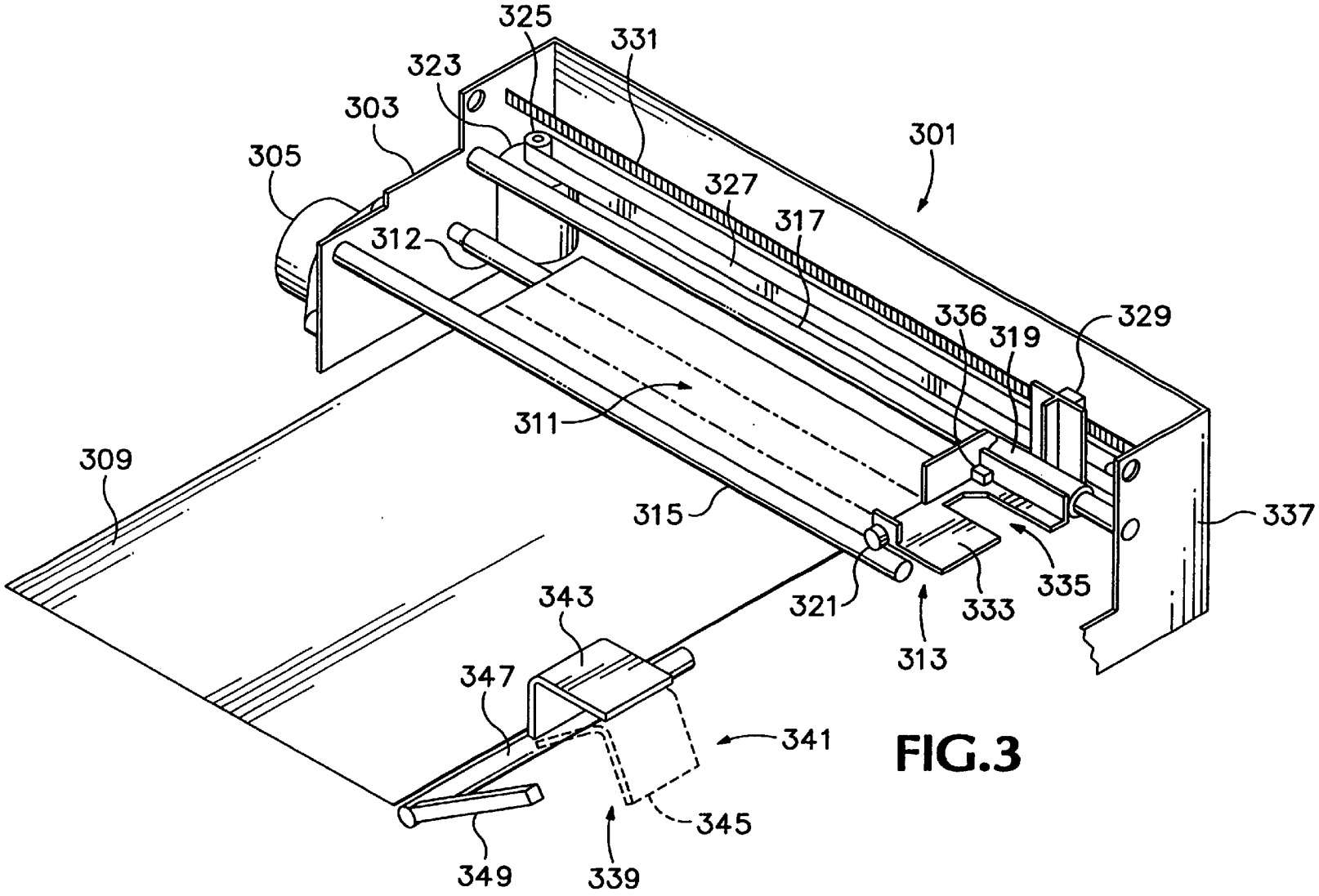
FIG. 3 is a perspective view, schematic drawing (partial cutaway) of pertinent components of a modular hard copy engine in accordance with the present invention for use in conjunction with a writing engine in accordance with the present invention.
Figure 13:
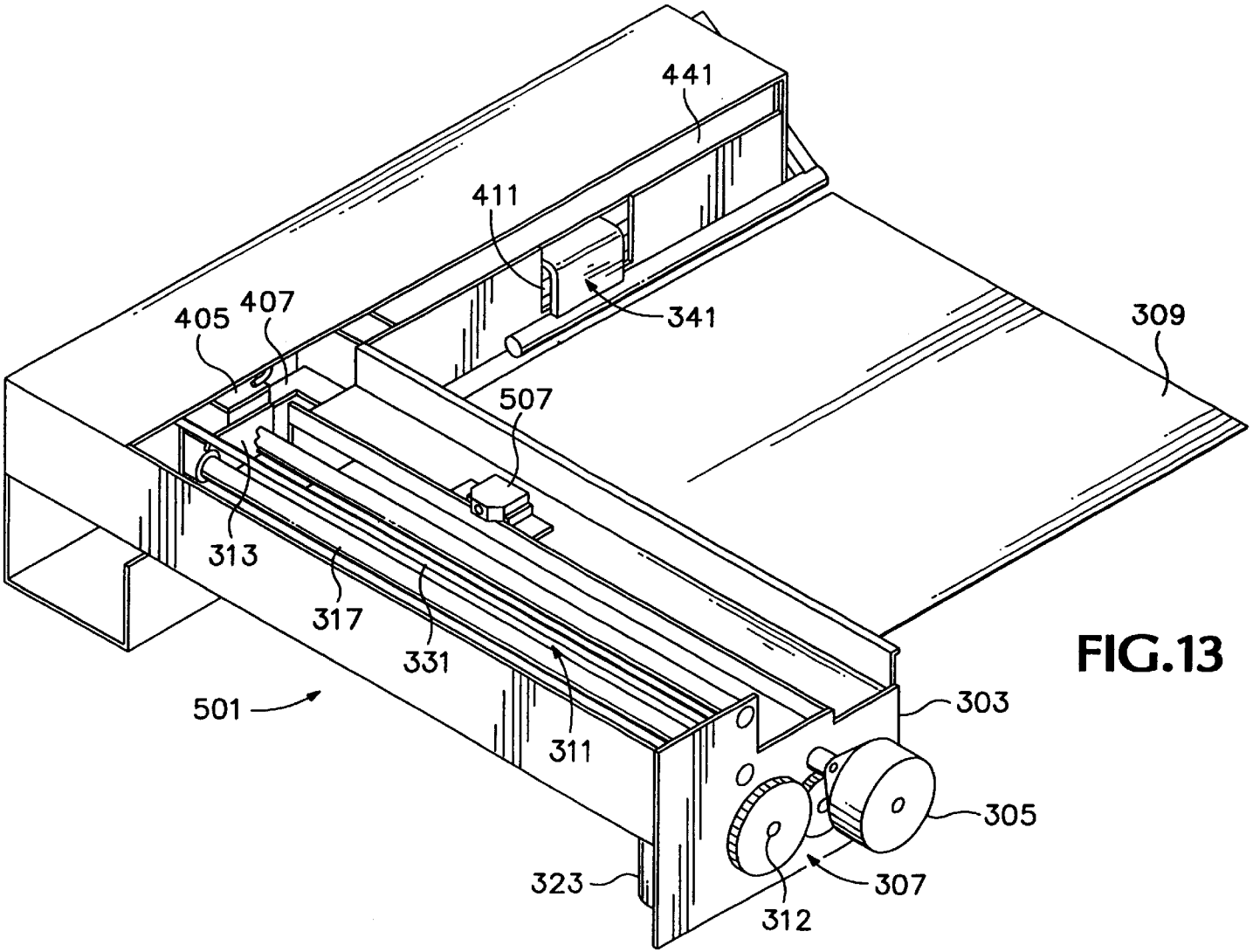
FIG. 13 is a perspective view in accordance with the present invention as shown in FIGS. 4 and 5A with the writing engine module installed in the hard copy engine in a "ready mode."

When the carriage 313, FIG. 3, has positioned the printing submodule 405, FIG. 6 and FIG. 13, in the writing engine 401, proximately to the service station 60, the pinion gear 65 drives the pallet 62 via the rack gear 64 until arms 92, extending upwardly from sled 85, engage either the body of printing submodule 405, or the carriage 313. The pinion gear 65 continues to drive the pallet 62 toward the right as shown in FIG. 16, which causes the sled 82 to rise upwardly from the pallet, extending the spring 90, until the caps 69 engage the respective print heads 54, 56. While the pairs of links 86, 88 are shown in an upright position to cap in FIG. 16, it is apparent that an angled orientation with respect to the pallet 62 may also be useful in some implementations, for example to accommodate slight elevational variations in the printheads 54, 56.

Thus, the pinion gear 65 may drive the pallet 62, via the rack gear 64, back and forth in the direction of arrow 66 to position the pallet 62 at various locations to service the printheads 54, 56. To wipe the print heads 54, 56, the platform preferably is reciprocated back and forth as indicated by arrow 66. To spit through the nozzles to clear any blockages, or to monitor temperature rises and the like, the platform is moved into a nozzle clearing position where the spit target 75 is under the printheads. The capping motion of the platform is described above. To remove any ink residue from the surface of the spit target 75, the pallet 62 is moved until the target 75 is scraped by blade 80 and into a bin 84. If necessary, the pallet 62 maybe reciprocated back and forth to scrape the target 75.

Further details regarding this particular service station may be obtained by reference to U.S. patent application Ser. No. 08/862,952, however, further detail is not essential to an understanding of the present invention.

Details regarding still another type of translational motion service station, such as shown herein in FIGS. 4, 5, 13 and 14 as useful in accordance with the present invention is described in U.S. patent applications Ser. No. 08/667,611, filed on Jul. 3, 1996, for an Integrated Translational Service Station for Inkjet Printheads (assigned to the common assignee of the present invention and incorporated herein by reference).

While the service station is preferably within the writing engine module, it can be in the hard copy engine and delivered into a writing engine module upon insertion into the hard copy engine. However, this obviates many of the advantages of having a disposable, or refurbishable, service station component manufactured into the writing engine module. The most egregious problem created is that a module removed without capping the print head would likely cause printing failure upon any attempt to reuse the module at a later date.

Figure 17:
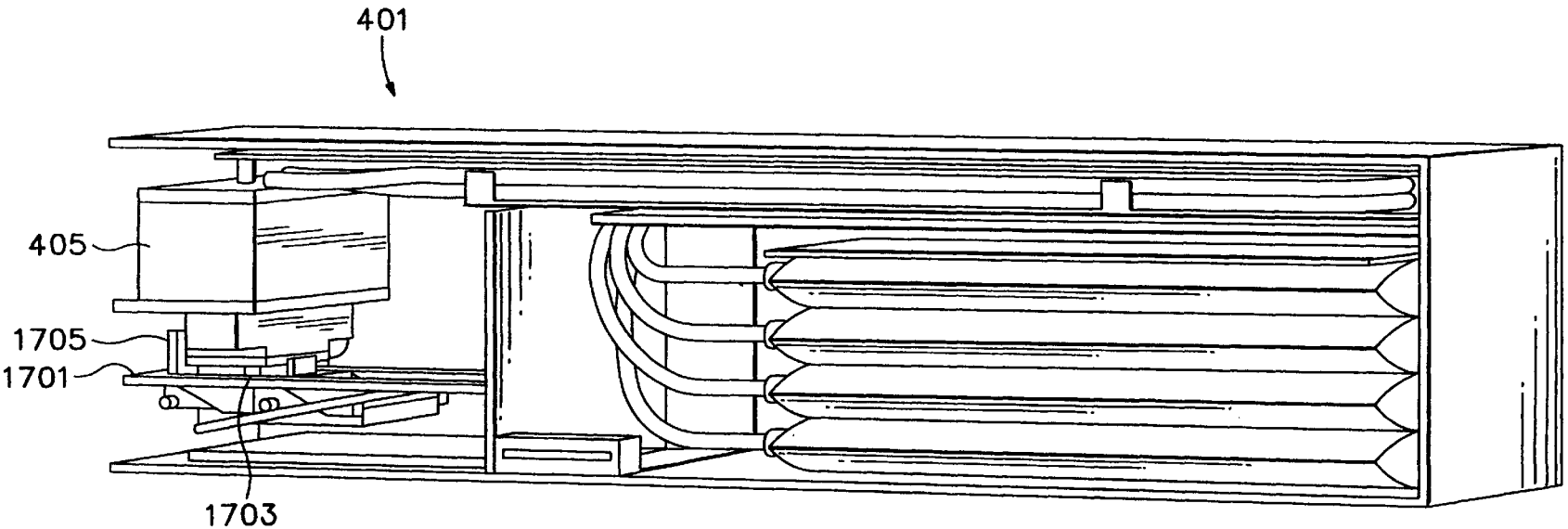
FIG. 17 is a perspective view of an alternative embodiment of the present invention as shown in FIG. 4, in which an alternative service station construct is depicted.

At a minimum, the writing module should include a print head capping device. Turning to FIG. 17, a writing engine 401 having a service station sled 1701 having only a print head cap 1703 is mounted thereon (compare FIG. 4). A cap locator 1705 ascends upwardly from the sled 1701 to contact a face of the printing submodule 405 in order to locate the cap 1703 relative to the print head.

Operation

Figure 7:
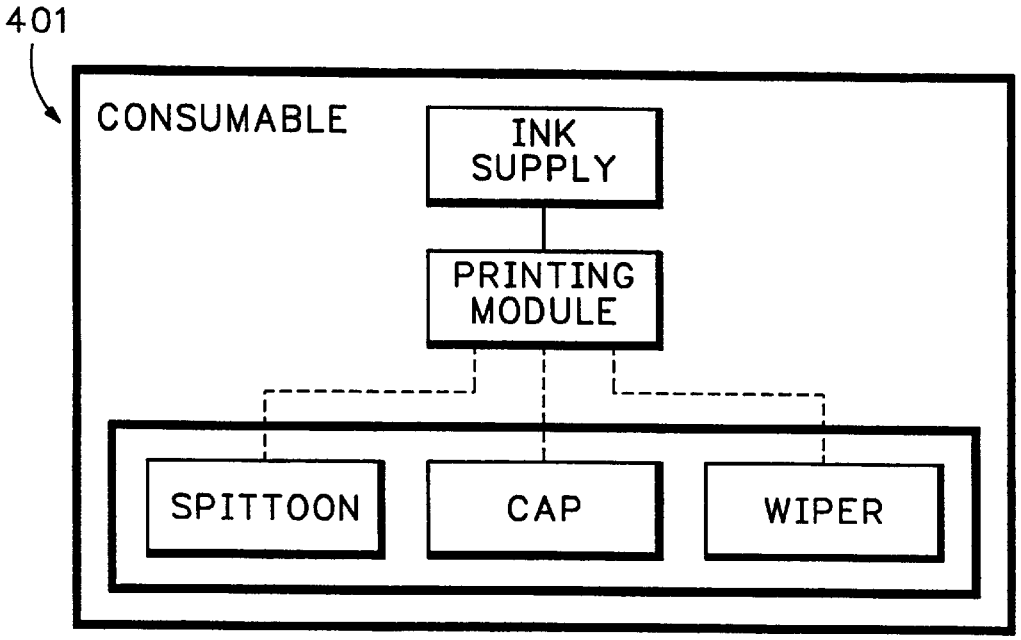
FIG. 7 is a fluidic block diagram in accordance with the present invention as shown in FIG. 4.
Figure 8:
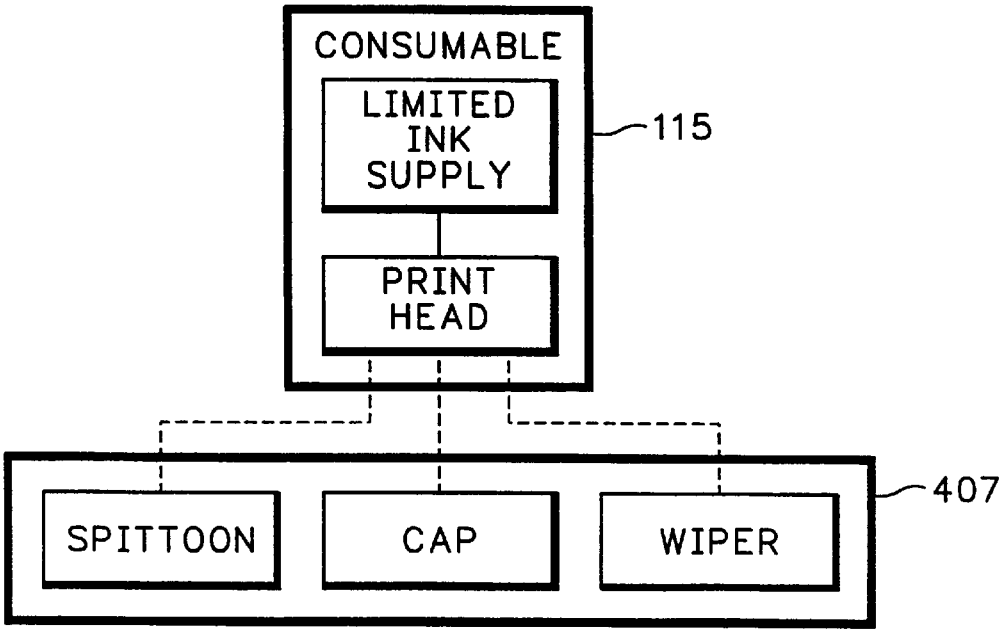
FIG.8 (PRIOR ART)
FIG. 8 (Prior Art) is a fluidic block diagram for a disposable print cartridge based ink-jet system.
Figure 9:
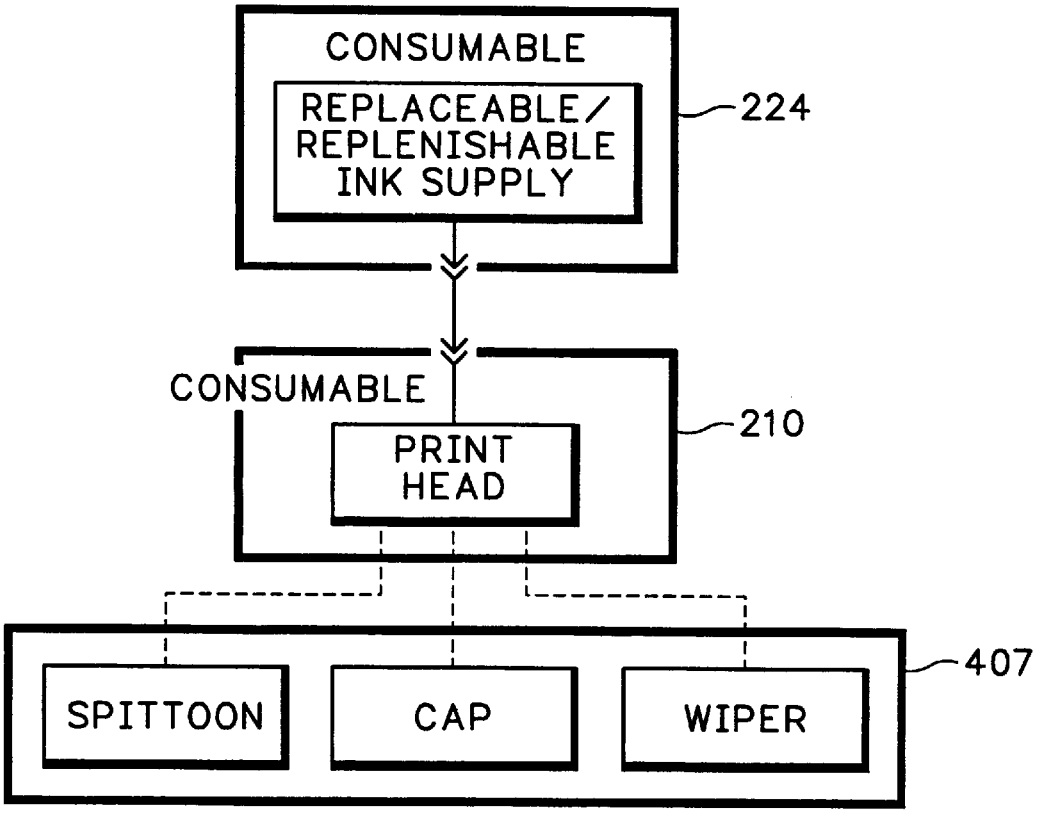
FIG.9 (PRIOR ART)
FIG. 9 (Prior Art) is a fluidic block diagram for a replaceable ink supply based ink-jet system.
Figure 10:
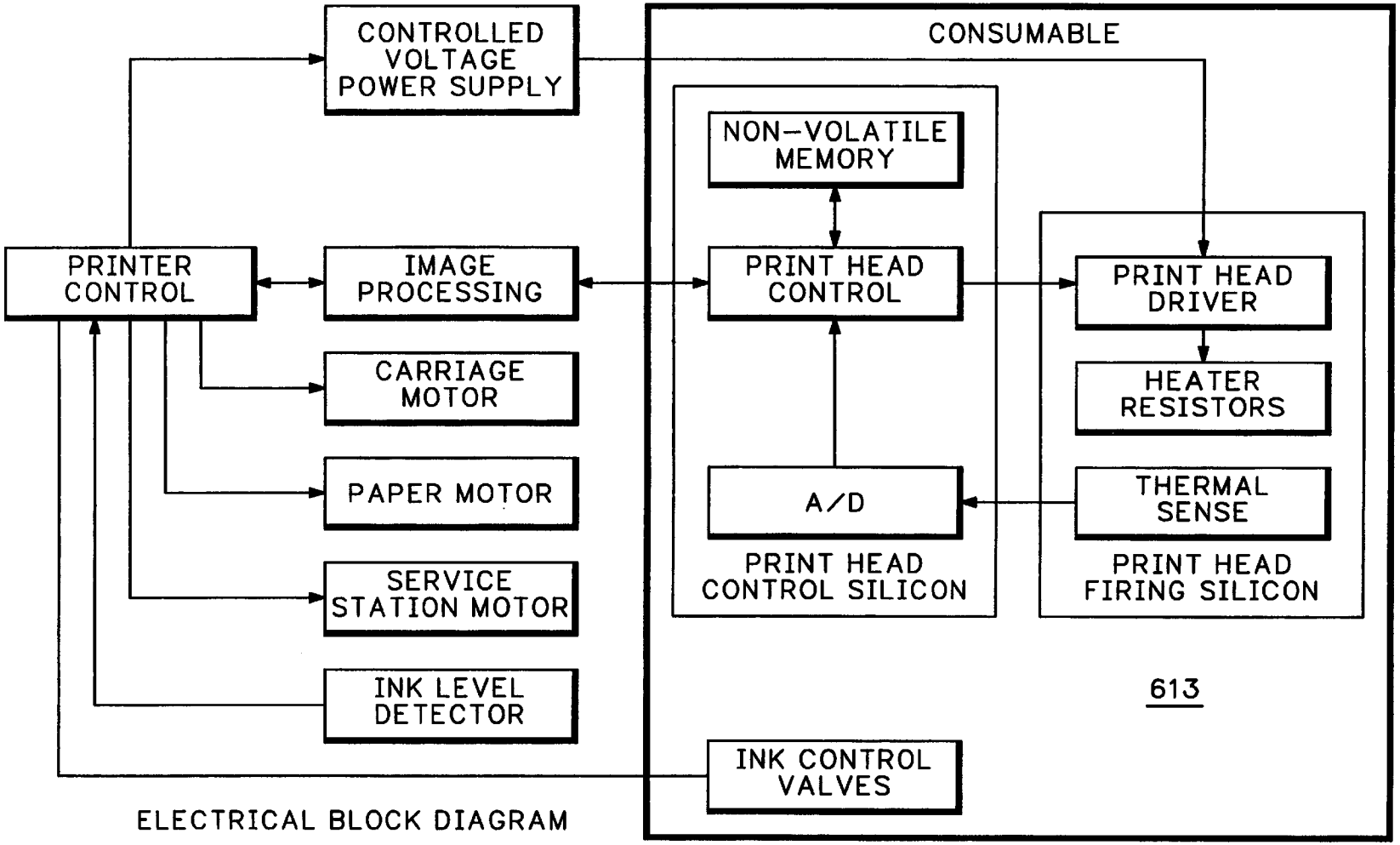
FIG. 10 is an electrical block diagram in accordance with the present invention as shown in FIG. 4.

The fundamental repartitioning of an ink-jet hard copy apparatus in accordance with the present invention is depicted in block diagram form by FIGS. 7 and 10, and compared with the prior art in FIGS. 8, 9, 11, and 12.

FIG. 7 depicts the fluidic construct of a consumable writing engine 401 in accordance with the present invention.

Figure 2:
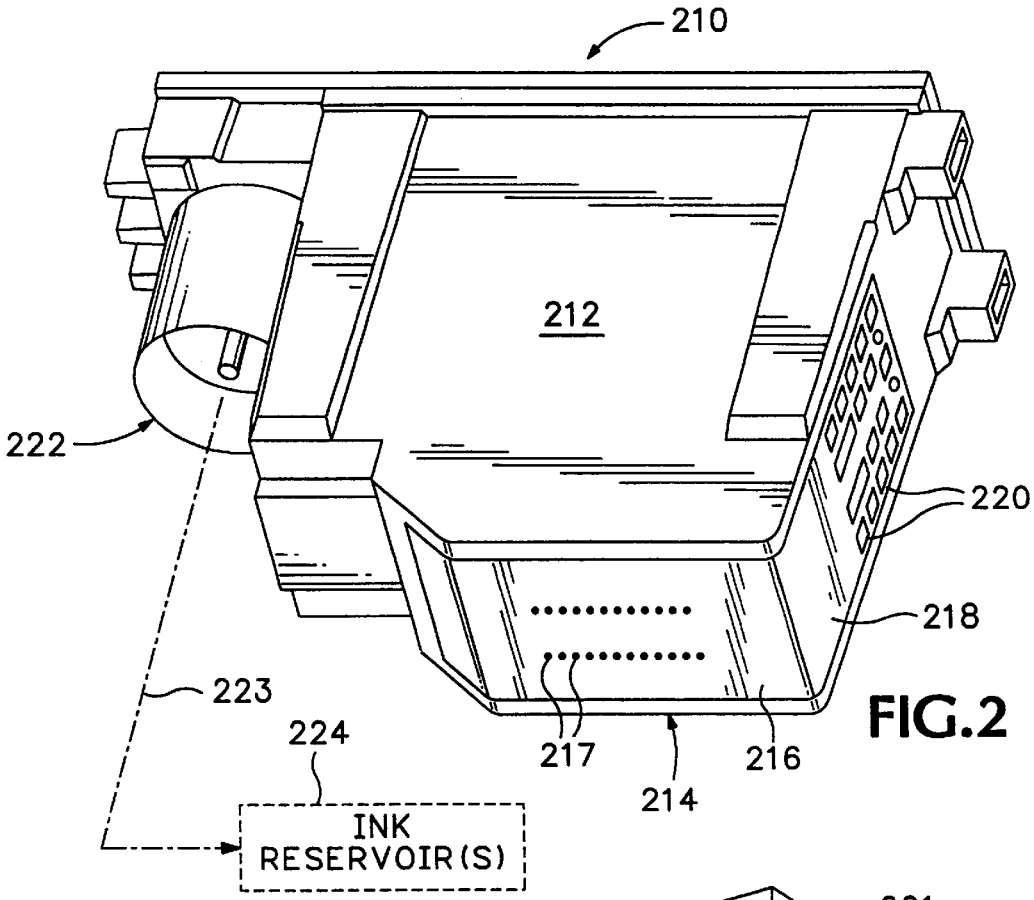
FIG. 2 is a perspective view, schematic drawing of an ink-jet pen as may be used in an apparatus such as shown in FIG. 1.

In comparison, a typical commercial print cartridge, such as the Hewlett-Packard™ 51626 cartridge used in HP™ DeskJet™, OfficeJet™ and other popular hard copy machines is depicted by FIG. 8 (PRIOR ART); note that a service station 407 for such a commercial print cartridge is required to be an integral part of the hard copy apparatus and have a concomitant life expectancy and accompanying capability. A replaceable ink-jet cartridge product, such as shown in FIG. 1, using a semipermanent pen as in FIG. 2, is depicted in FIG. 9 (PRIOR ART); two consumables are requisite to such systems and the service station 407 must be permanent as in the system of FIG. 8. Thus, comparison with FIG. 7 shows distinct consumables partitioning differences which also indicate accomplishment of goals and advantages in accordance with the present invention as enumerated in the Summary of the Invention section above.

Figure 11:
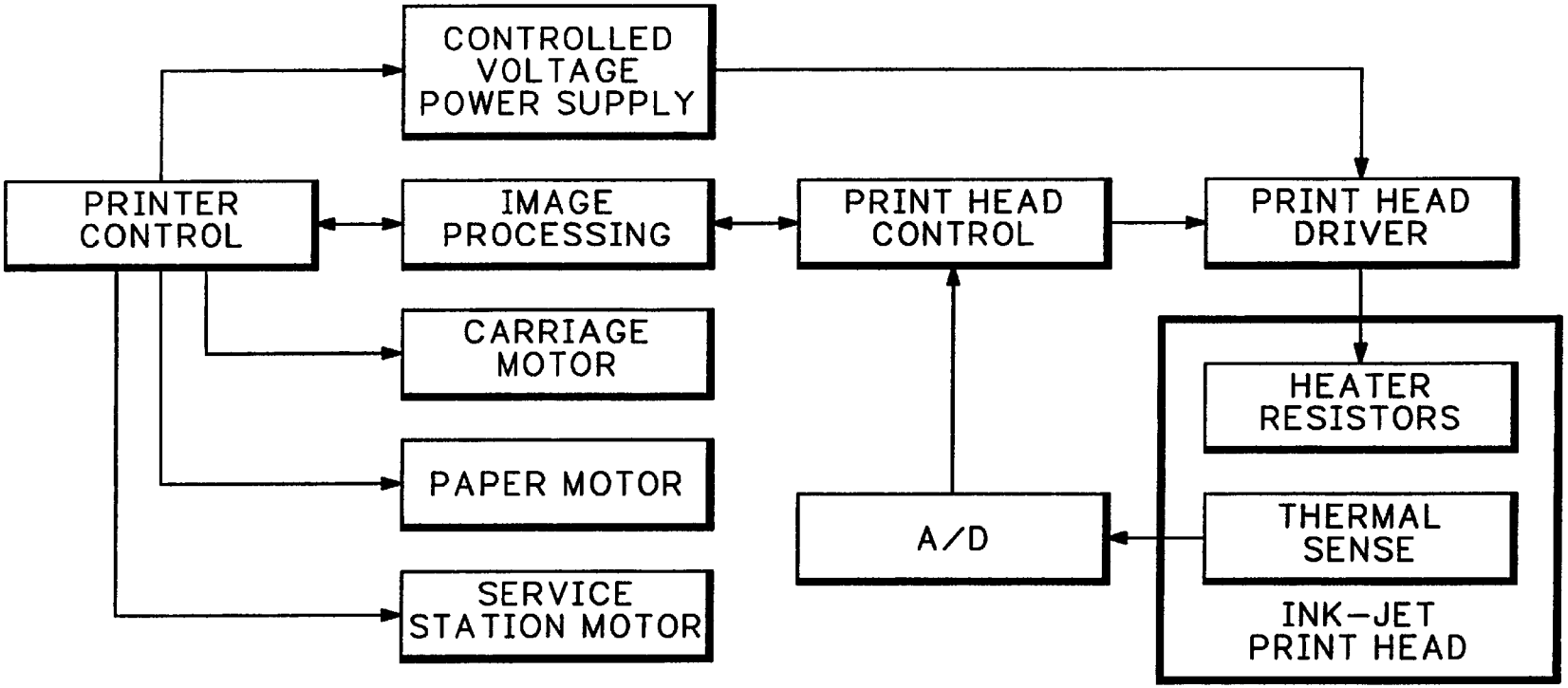
FIG.11 (PRIOR ART)
FIG. 11 (Prior Art) is an electrical block diagram for an HP™ DeskJet™ 850C computer printer, being of the type using a disposable print cartridge system as shown in FIG. 8.
Figure 12:
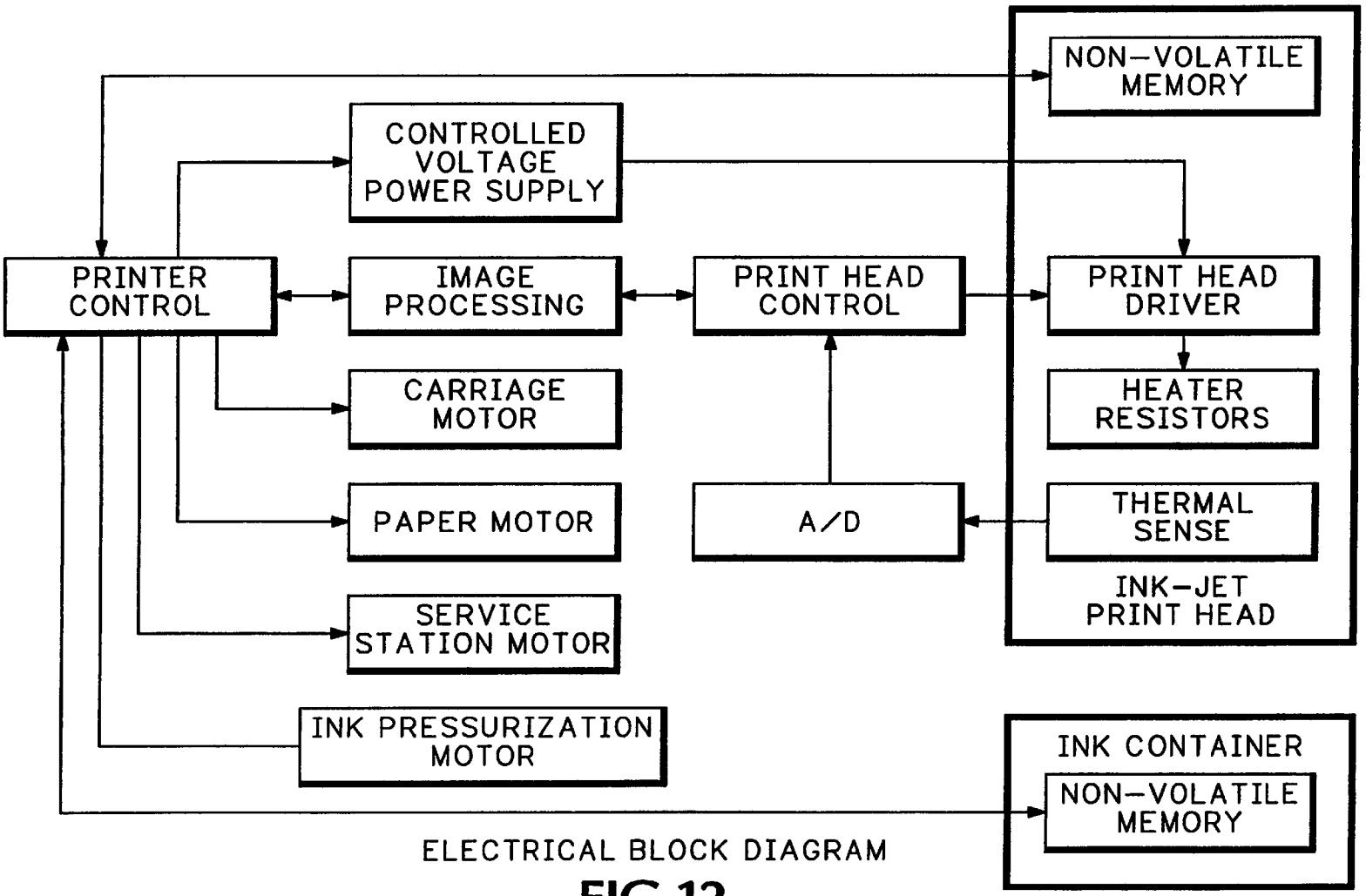
FIG.12 (PRIOR ART)
FIG. 12 (Prior Art) is an electrical block diagram for a hard copy apparatus of the type using a replaceable ink supply system as shown in FIG. 9.

A similar set of FIGURES depict the differences in electronic system partitioning, FIGS. 10–12. FIG. 10 depicts partitioning in accordance with the present invention. FIG. 11 (PRIOR ART) depicts partitioning as is common to a commercial product, e.g., the HP DeskJet 850C printer which uses print cartridges as discussed above. FIG. 12 depicts an off-axis system such as would be implemented in a printer using the semipermanent pen 210 of FIG. 2. It is known in the art to provide control algorithms for writing instrument servicing, refilling, and printing (e.g., print modes and color maps). Having wet systems control within the writing engine module, provides the advantage of allowing upgraded control with other writing system changes.

In other words, the electronics is partitioned in accordance with the present invention such that the designer of the hard copy apparatus needs minimal knowledge of ink-jet requirements. In the preferred implementation, to print, the hard copy apparatus would merely address the writing engine specifying a given color on a certain dot grid or pixel. The writing engine would automatically adjust for different ink formulations, ink color maps, and drop volumes. Moreover, the writing engine would contain enough knowledge to have complete control over all servicing and ink refill algorithms. A new writing engine, adhering to the same protocol could be added later in the product's lifetime. A new writing engine would thus allow design freedom not currently present in non-modular systems with regard to inks, drop sizes, dot matrix ink drop manipulation, and service station algorithms.

This partitioning puts intelligence in the writing engine module. There are three levels of implementation. The most basic level would be to have the lowest level information about the writing engine contained in the writing engine module. Pulse timing, drop firing order, and related information would be contained in the writing engine. The hard copy apparatus would think of the pen as a column of x-picoliter drops. This relieves the hard copy apparatus designer of needing knowledge of the lowest level of ink-jet pen requirements. For minor enhancements, these are the parameters most likely to change, and these could be changed and the new writing engines would still be backward compatible with the hard copy apparatus in the field.

The next level is to enable addressing of the writing engine independent of drop volume and ink color maps. The hard copy apparatus would address the writing engine requiring specific calibrated colors on a specified grid. The writing engine would contain the information for translation. New inks with different color maps could be added, and the modified color maps in the writing engine would compensate automatically with no change to the hard copy apparatus. The writing engine would adjust for drop volume and target grid changes. A writing engine based on a 10-pl pen would take the 300 dpi, 30-pl drop data and automatically translate it to 10-pl drop data, firing three drops for every 30-pl drop request.

At the highest level, the writing engine would have control over all its needs. This includes control of servicing algorithms and ink valves. This could be implemented similar to a JAVA™ applet, which would be uploaded from the writing engine to the hard copy apparatus to control these algorithms, or with a more targeted protocol. For a servicing algorithm, the writing engine would instruct the carriage to move to a certain position, and then automatically fire certain drops. For ink delivery control, there could be inputs from certain sensors detecting ink level and outputs to valves controlling the ink flow. The control algorithm would be run from the writing engine, and could be easily upgraded with a new writing engine.

Again, a comparison of FIGS. 11 and 12 with FIG. 10 shows distinct consumables partitioning differences that indicate accomplishment of the goals and advantages in accordance with the present invention as enumerated in the Summary of the Invention section above. The writing engine controller can thus be an integrated circuit which controls ink droplet sequencing, firing, pulse timing, firing energy control, temperature control, drop volume scaling, dot position correction, color conversion algorithms, color maps, print mode algorithms, interface protocols, and the like as may be current in the state of the art for ink-jet print head operations, and also writing instrument servicing and refilling algorithms.

FIGS. 13 and 14 show a combined hard copy engine and writing engine forming a hard copy apparatus. In the main, when not printing, as depicted in FIGS. 5 and 13, the inserted printing submodule 405 is capped by the service station 407 (see also; FIG. 4). Pressure is being applied to ink reservoir pressure plate 441 via biased pressure applicator 341 such that a positive pressure is exerted on each of the ink reservoirs 411–417. A sheet of print media 309 is transported by the stepper motor 305 and associated transmission 307 coupled to the paper drive roller 312 to have a printing zone 311 subjacent the print head (hidden) of the printing submodule 405 now coupled to the scanning carriage 313 and set to be driven transversely back-and-forth across the print zone 311 by motor 323.

FIG. 14 shows the system while a printing operation is under way. The service station 407 has been translated out of the way (compare position with FIG. 13), uncapping the print head, and wiping the nozzle plate. Any spitting algorithms to clear and prime print head orifices have been carried out. The carriage 313, driven by reversing motor 323 under control of the "Printer Control," FIG. 10, traverses ("x-axis" as indicated by arrows) the printing zone 311 of the print medium 309. The swing arm 451, carrying the ink tubes 421–427, and flex circuit 609 (not shown, but see FIG. 15), being pivotally coupled to the printing submodule 405, follows the movement of the carriage 313. During traversing, image processing data (see FIG. 10, "Image Processing") transferred into the writing engine integrated circuit 613 (FIGS. 6 & 10) is used in a known manner or proprietary algorithm manner of dot matrix printing to fire ink droplets from the print head 611 (also FIG. 6) orifices 621 onto the print medium 309. After completing a swath scan in accordance with an employed print mode algorithm (e.g., 1-pass, 2-pass, et seq.), the print medium 309 is stepped ("y-axis" as indicated by the labeled arrow) to position the next swath print zone 311 beneath the print head 611. Whether the leading edge of print media comes in from the front, back, top, or bottom of the hard copy engine printing station is a matter of design choice.

When the ink detector 507 sends a signal that the printing submodule 405 is low on ink, the carriage 313 returns the printing module back into the writing engine and a refill cycle is implemented. Once completed, printing resumes. Note carefully, that on-the-fly refilling algorithms are also employed in accordance with the present invention. For an example, refer to U.S. Pat. No. 5,650,811, issued on Jul. 22, 1997, to Seccombe et al. for an Apparatus for Providing Ink to a Printhead [sic](assigned to the common assignee of the present invention and incorporated herein by reference). It is contemplated generally that the writing instrument can be refilled on demand, whether docked within the writing engine or continuously during a printing operation. A variety of implementations are known in the art or can be developed as a proprietary construct.

Alternative Embodiments

Figure 18:
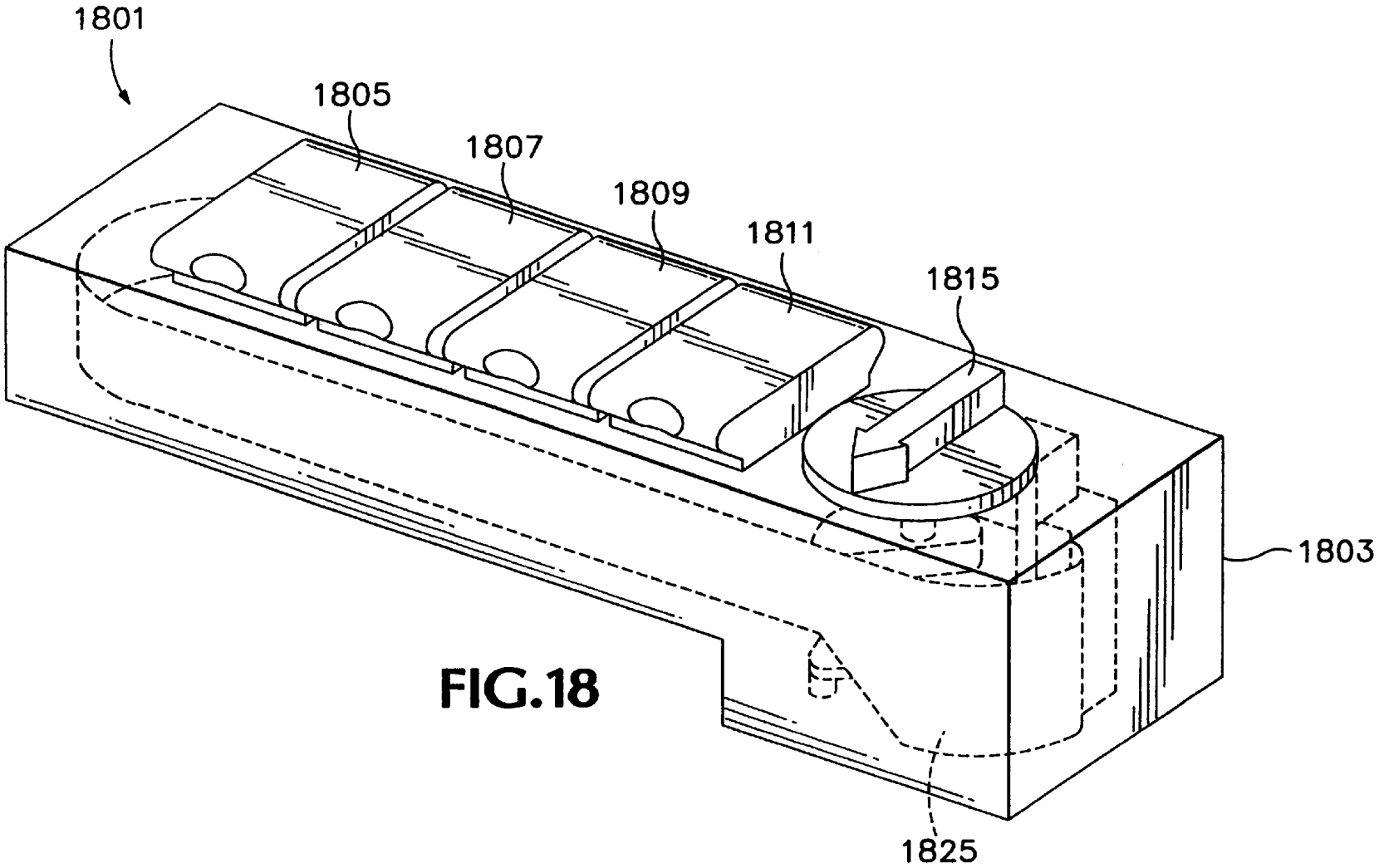
FIG. 18 is an alternative embodiment of a writing engine in accordance with the present invention in a perspective view (overhead angle).
Figure 19:
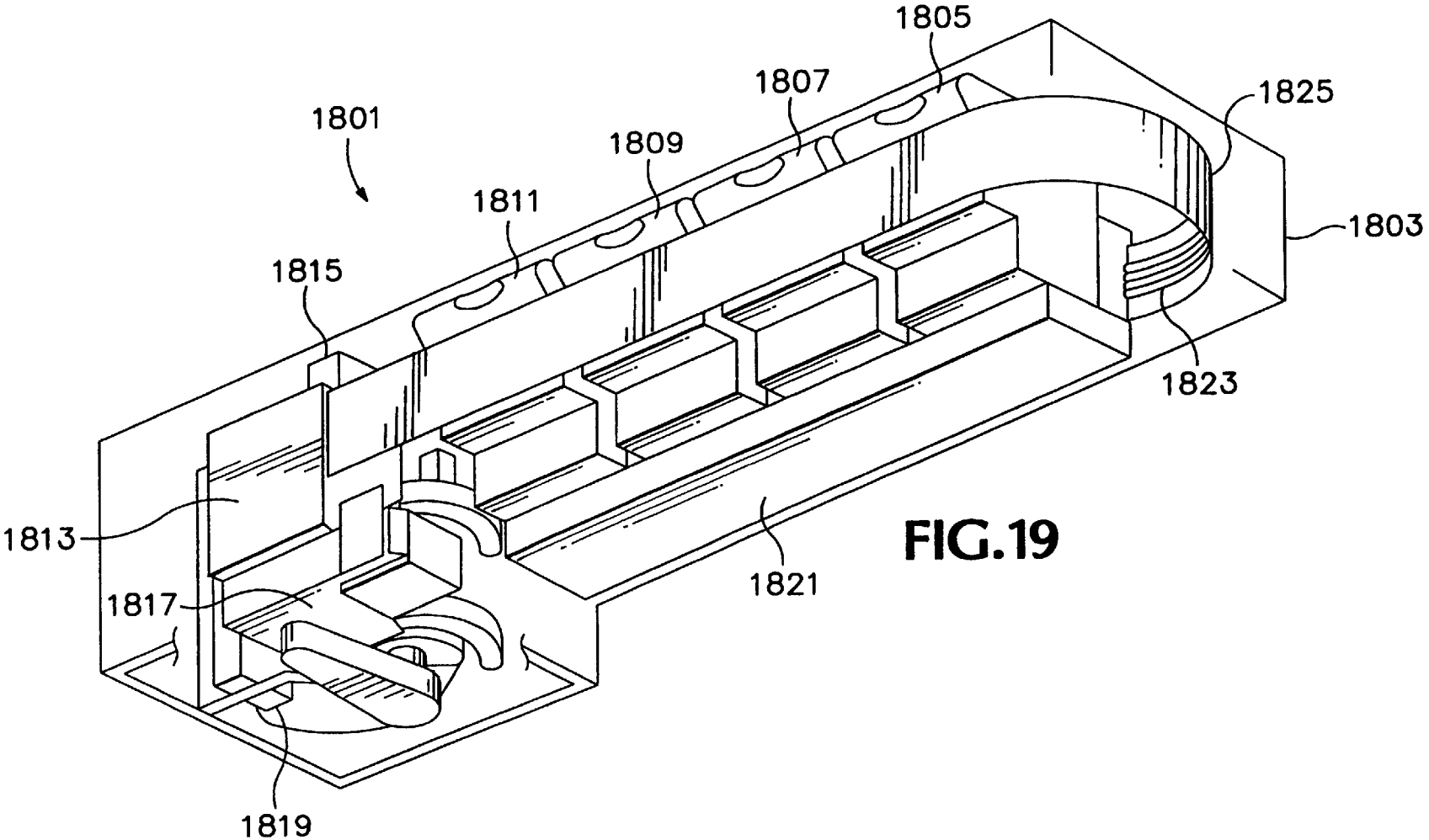
FIG. 19 is the alternative embodiment of the writing engine as shown in FIG. 18 in a perspective view (bottom angle).

FIGS. 18 and 19 depict an alternate embodiment of a writing engine 1801. A housing 1803 is configured to be received in a complementary hard copy engine (not shown) such that the writing engine module lies across the print zone (see FIG. 3, 311). Four integral ink reservoirs 1805, 1807, 1809, 1811 are individually mounted into the housing 1803. In the preferred embodiment, the reservoirs 1805–1811 are self-pressurizing. Note that this not only makes manufacturing simpler, it also makes the writing engine 1801 refurbishable or reconfigurable by making reservoirs that can be replaced at will. However, it should be recognized that providing the end-user with individual replacement reservoirs will obviate certain advantages of a unitary writing engine module and could lead to serious equipment failures if incompatible inks are mixed.

At one end of the writing engine 1801, an ink-jet print head 1813 (FIG. 19 only) is located such that when the writing engine is installed in the compatible hard copy engine it is positioned approximately superjacent one end of the print zone. A cam latching and unlatching device 1815 is provided for releasing the print head 1813, a service station 1817, and electrical connector 1819 for interlocking with complementary hard copy engine activation mechanisms in a similar manner to the prior embodiment (see e.g., elements 313, FIG. 3, and FIG. 16). An ink manifold 1821 incorporating appropriate fluid couplings to the print head 1813 via ink tubes 1823 (FIG. 19 only) is mounted in the housing 1803 such that insertion of an individual ink reservoir 1805–1811 releases ink from within each reservoir into the manifold 1821, e.g., a snap-fit that breaks a seal of the reservoir. As with the prior embodiment, a traveling flex circuit 1825 is mounted to be able to follow the print head 1813 as it traverses a print medium.

Inks

"Ink" is used generically herein for any ink, dye (e.g., fabric dyes for garment printing), colorant, toner, hot-melt composition, printing fluid, or the like, which is compatible with ink-jet technology. A distinct advantage of the present invention is the ability to provide the end-user with a variety of easily interchangeable writing engines, each having distinct printing characteristics. For example, for heavy duty alphanumeric text printing, a single, large volume, black ink writing engine cassette can be installed; for printing photographic quality prints, a set of different color ink reservoirs—e.g., cyan light, cyan dark, magenta light, magenta dark, yellow, and black—in a single writing engine cassette is installed.

Again, while having the writing engine configured as a one-time use construct is preferred, kits can be supplied for replacing or refilling the reservoirs.

The present invention provides a reconfigured ink-jet system and subsystem components thereof that is useful in the printing field and which provides unique methodologies of manufacturing, fabricating, constructing, assembling, using, operating, refurbishing, rejuvenating, restoring, and providing components for an ink-jet hard copy apparatus. The foregoing description of embodiments of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. A modular hard copy apparatus comprising:

a first unitary module including essential hard copy engine components, said first unitary module having a first equipment life expectancy;

a second unitary module including essential ink-jet writing engine ink-jetting and ink-jet servicing components, said second unitary module having a second equipment life expectancy substantially shorter than said first equipment life expectancy; and located on said first unitary module and said second unitary module, complementary mechanisms for selectively interfacing said second unitary module into said first unitary module such that inserting said second unitary module into said first unitary module automatically forms an operationally ready ink-jet hard copy apparatus wherein said second unitary module is replaceable wherein said second unitary module is replaceable a plurality of times wherein a number of replacement times is approximately equal to a ratio of said first equipment life expectancy to said second equipment life expectancy.

2. The modular hard copy apparatus as set forth in claim 1, further comprising:

said second unitary module including at least one pressurizable ink container having a supply of ink therein;

said first unitary module having a mechanism for automatically pressurizing said pressurizable ink container upon insertion of said second unitary module into said first unitary module.

3. The modular hard copy apparatus as set forth in claim 1, said second unitary module further comprising:

at least one ink-jet printing component adapted for interfacing with a first complementary mechanism of said first unitary module such that said printing component is extractable from said second unitary module by said first complementary mechanism for translation of said printing component to a position for printing within said first unitary module and reinsertion of said printing component into said second unitary module following printing.

4. The modular hard copy apparatus as set forth in claim 3, further comprising:

said first unitary module including a printing station print zone;

said first complementary mechanism including first mechanical interface components for aligning said second unitary module to said first unitary module and second mechanical interface components for aligning said printing component to said print zone.

5. The modular hard copy apparatus as set forth in claim 4, further comprising:

said second unitary module including an ink-jet printing component service station;

said first unitary module including third mechanical interface components including an activating mechanism for activating at least some operational functions of said service station.

6. An ink-jet hard copy apparatus comprising:

an integrated first module including essential hard copy engine dry components, said integrated first module having a first equipment life expectancy;

an integrated second module including essential ink-jet writing engine wet components, said integrated second module having a second equipment life expectancy substantially shorter than said first equipment life expectancy; and located on said integrated first module and said integrated second module, complementary mechanical and electromechanical mechanisms for selectively interfacing said integrated second module into said integrated first module such that inserting said integrated second module into said integrated first module automatically forms an operationally ready ink-jet hard copy apparatus wherein said integrated second module is replaceable throughout said first equipment life expectancy.

7. The ink-jet hard copy apparatus as set forth in claim 6, further comprising:

said integrated second module including an ink-jet print head; and said second equipment life expectancy is approximately equal to the ink-jet print head operational life expectancy.

8. An ink-jet printer comprising:

a hard copy engine having a cassette bay;

a first writing engine cassette including ink having a first composition; and a second writing engine cassette including ink having a second composition, wherein said first composition and said second composition have mutually incompatibilities for ink-jet printing, said cassette bay selectively receiving either said first writing engine cassette or said second writing engine cassette for printing such that no contamination of the hard copy engine is incurred due to said mutual incompatibilities during serial selection of said first writing engine and said second writing engine.

9. A modular hard copy apparatus comprising:

a first unitary module including essential hard copy engine components, said first unitary module having a first equipment life expectancy;

a second unitary module including essential ink-jet writing engine ink-jetting and ink-jet servicing components, said second unitary module having a second equipment life expectancy substantially shorter than said first equipment life expectancy; and located on said first unitary module and said second unitary module, complementary mechanisms for selectively interfacing said second unitary module into said first unitary module such that inserting said second unitary module into said first unitary module automatically forms an operationally ready ink-jet hard copy apparatus wherein said second unitary module is replaceable, wherein said second unitary module includes at least one pressurizable ink container having a supply of ink therein, and said first unitary module having a mechanism for automatically pressurizing said pressurizable ink container upon insertion of said second unitary module into said first unitary module.

10. A modular hard copy apparatus comprising:

a first unitary module including essential hard copy engine components, said first unitary module having a first equipment life expectancy;

a second unitary module including essential ink-jet writing engine ink-jetting and ink-jet servicing components, said second unitary module having a second equipment life expectancy substantially shorter than said first equipment life expectancy; and located on said first unitary module and said second unitary module, complementary mechanisms for selectively interfacing said second unitary module into said first unitary module such that inserting said second unitary module into said first unitary module automatically forms an operationally ready ink-jet hard copy apparatus wherein said second unitary module is replaceable, wherein said second unitary module further includes at least one ink-jet printing component adapted for interfacing with a first complementary mechanism of said first unitary module such that said printing component is extractable from said second unitary module by said first complementary mechanism for translation of said printing component to a position for printing within said first unitary module and reinsertion of said printing component into said second unitary module following printing.

* * * * *